US012557872B2

(12) United States Patent
Hultgren

(10) Patent No.: US 12,557,872 B2
(45) Date of Patent: Feb. 24, 2026

(54) ADJUSTMENT DEVICE FOR ARTICLE OF APPAREL OR FOOTWEAR AND RELATED CONTROLS

(71) Applicant: NIKE, Inc., Beaverton, OR (US)

(72) Inventor: Samantha Jean Hultgren, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/466,350

(22) Filed: Sep. 13, 2023

(65) Prior Publication Data

US 2024/0081469 A1 Mar. 14, 2024

Related U.S. Application Data

(60) Provisional application No. 63/375,650, filed on Sep. 14, 2022.

(51) Int. Cl.

| | |
|---|---|
| ***A43B 7/00*** | (2006.01) |
| ***A41D 13/005*** | (2006.01) |
| ***A43B 23/02*** | (2006.01) |

(52) U.S. Cl.

CPC ..... *A43B 7/005* (2013.01); *A41D 13/005* (2013.01); *A43B 23/029* (2013.01)

(58) Field of Classification Search

CPC ... A43B 13/189; A43B 13/20; A43B 13/0155; A43B 13/018; A43B 5/0407; A43B 23/029; A43B 23/0285; A43B 17/03

See application file for complete search history.

(56) References Cited

U.S. PATENT DOCUMENTS

| | | | | |
|---|---|---|---|---|
| 12,127,608 | B2 * | 10/2024 | Casillas | A41C 3/105 |
| 2013/0263349 | A1 * | 10/2013 | Roser | A43B 23/028 2/22 |
| 2014/0165427 | A1 | 6/2014 | Molyneux et al. | |
| 2016/0278444 | A1 * | 9/2016 | Jordan | A41D 1/002 |
| 2017/0049164 | A1 * | 2/2017 | Gruentzig | A41D 3/00 |
| 2017/0119314 | A1 * | 5/2017 | Just | A61B 5/6844 |
| 2018/0132564 | A1 * | 5/2018 | Bruce | A43B 13/189 |
| 2019/0053572 | A1 | 2/2019 | Patton | |
| 2019/0111307 | A1 * | 4/2019 | White | D04B 1/24 |
| 2019/0133215 | A1 * | 5/2019 | Whalen | A63B 21/4017 |
| 2020/0219370 | A1 * | 7/2020 | West | A41D 1/002 |

(Continued)

FOREIGN PATENT DOCUMENTS

WO WO-2016205035 A2 12/2016

OTHER PUBLICATIONS

European Patent Office (ISA), International Search Report and Written Opinion for PCT App. No. PCT/US2023/074161, mailed Dec. 18, 2023.

*Primary Examiner* — Patrick J. Lynch
(74) *Attorney, Agent, or Firm* — Honigman LLP; Matthew H. Szalach; Jonathan P. O'Brien

(57) ABSTRACT

An adjustment system for a wearable article includes an adjustment element operable to form at least a portion of the wearable article and including a bladder including an interior void and a compressible component disposed within the interior void, and a control module operably coupled to the adjustment element and configured to translate the compressible component between a relaxed state and a constricted state by controlling a volume of fluid within the interior void in response to a condition-responsive parameter.

20 Claims, 18 Drawing Sheets

(56) References Cited

U.S. PATENT DOCUMENTS

| | | | | |
|---|---|---|---|---|
| 2021/0120915 | A1* | 4/2021 | Panian | A43B 23/029 |
| 2021/0244128 | A1 | 8/2021 | Costa et al. | |
| 2022/0095710 | A1* | 3/2022 | Shahrivar | A41D 13/018 |
| 2022/0193490 | A1* | 6/2022 | Ghiotto | A63B 24/0006 |
| 2023/0071068 | A1* | 3/2023 | Yamane | G06N 3/08 |

* cited by examiner

ADJUSTMENT DEVICE FOR ARTICLE OF APPAREL OR FOOTWEAR AND RELATED CONTROLS

CROSS REFERENCE TO RELATED APPLICATIONS

This application claims priority under 35 U.S.C. § 119(e) to U.S. Provisional Application No. 63/375,650, filed on Sep. 14, 2022. The disclosure of this prior application is considered part of the disclosure of this application and is hereby incorporated by reference in its entirety.

FIELD

The present disclosure relates generally to an adjustment device for an article of apparel or footwear and more particularly to controlling an adjustment device for an article of apparel or footwear.

BACKGROUND

This section provides background information related to the present disclosure which is not necessarily prior art.

Articles of apparel such as garments and headwear and articles of footwear such as shoes and boots, typically include a receptacle for receiving a body part of a wearer. For example, an article of footwear may include an upper and a sole structure that cooperate to form a receptacle for receiving a foot of a wearer. Likewise, garments and headwear may include one or more pieces of material formed into a receptacle for receiving a torso or head of a wearer.

Articles of apparel or footwear are typically adjustable and/or are formed from a relatively flexible material to allow the article of apparel or footwear to accommodate various sizes of wearers, or to provide different fits on a single wearer. While conventional articles of apparel and articles of footwear are adjustable, such articles do not typically allow a wearer to conform the shape of the article to a body part of the wearer. For example, while clasps and elastic bands adequately secure an article of apparel to a wearer by contracting or constricting a portion of a garment around the wearer's upper body, they do not cause the garment to conform to the user's upper body. Accordingly, an optimum fit of the article of apparel around the upper body is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1A:
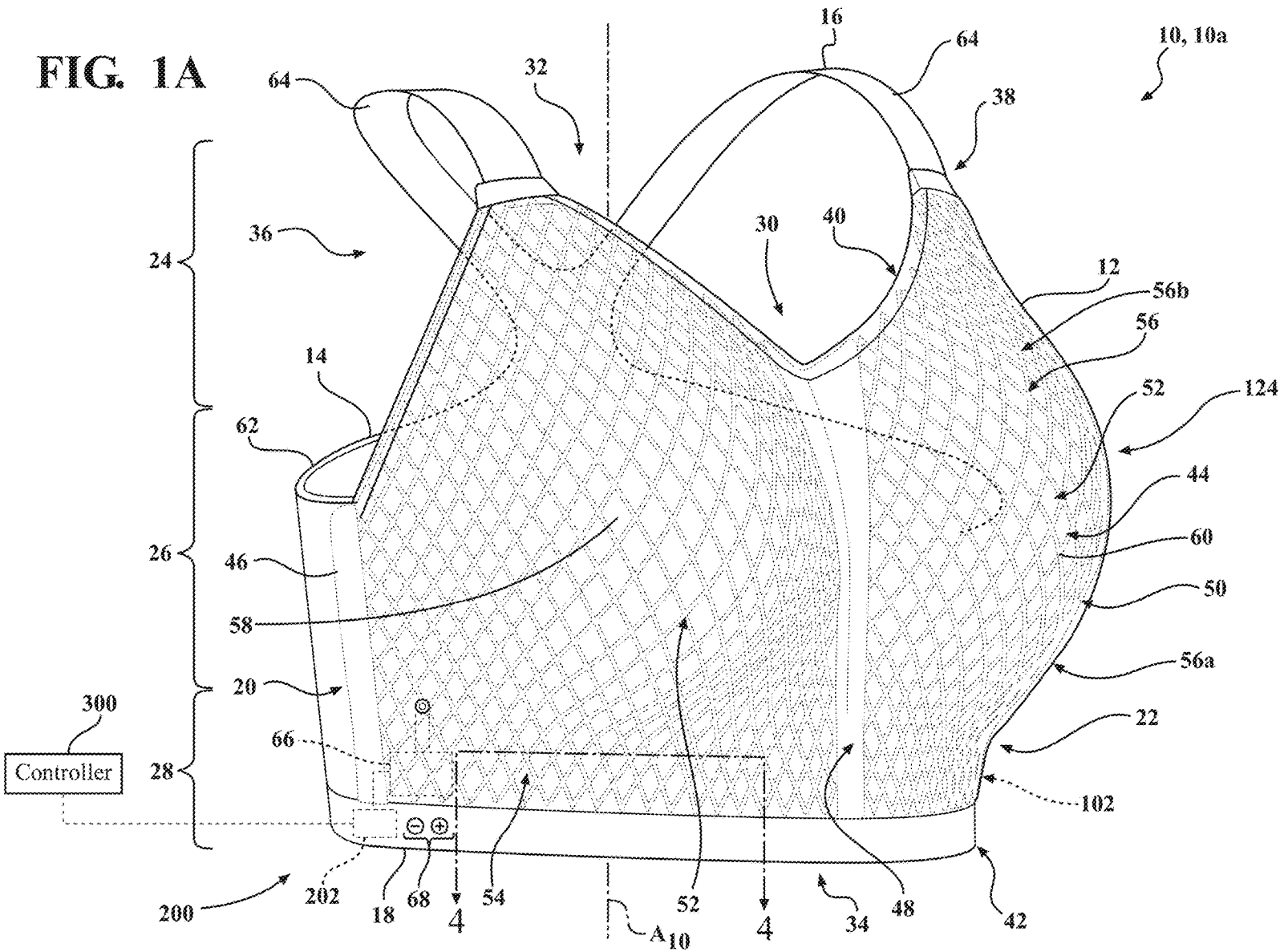
FIG. 1A is a perspective view of an example of an article of apparel according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As used herein, the term "approximately" means within a range of plus or minus 5 percent or 10 percent of an indicated value or range.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an adjustment system for a wearable article includes an adjustment element operable to form at least a portion of the wearable article and including a bladder including an interior void and a compressible component disposed within the interior void, and a control module operably coupled to the adjustment element and configured to translate the compressible component between a relaxed state and a constricted state by controlling a volume of fluid within the interior void in response to a condition-responsive parameter.

The adjustment system may include one or more of the following optional features. For example, the condition-responsive parameter may include motion, humidity, and/or temperature. The control module may be operable to translate the compressible component between the relaxed state and the constricted state in response to a geographical location of the control module and/or a type of activity. Optionally, the geographical location is input by a wearer. The geographical location may be determined using GPS. In one configuration, the control module may be operable to translate the compressible component between the relaxed state and the constricted state in response to a geographical location of the control module and/or a type of activity.

In another configuration, the adjustment system may include at least one of a humidity sensor, a temperature sensor, and an accelerometer in communication with the control module, the at least one of the humidity sensor, the temperature sensor, and the accelerometer operable to provide the control module with the condition-responsive parameter. Optionally, the adjustment system may include an RFID reader associated with the control module, the control module operable to translate the compressible component between the relaxed state and the constricted state based on data received by the RFID reader. In one configuration, an RFID tag may be associated with an article of apparel or an article of footwear, the RFID tag in communication with the RFID reader and operable to provide the data to the RFID reader. The adjustment system may further include a controller in communication with the control module and operable to display a status of the compressible component.

In another configuration, an adjustment system for a wearable article includes an adjustment element operable to form at least a portion of the wearable article and including a bladder including an interior void and a compressible component disposed within the interior void, and a control module operably coupled to the adjustment element and configured to translate the compressible component between a relaxed state and a constricted state by controlling a volume of fluid within the interior void in response to at least one of geographical location, activity type, and type of secondary wearable article used in conjunction with the wearable article.

For example, the control module may be operable to translate the compressible component between the relaxed state and the constricted state in response to a condition-responsive parameter. The condition-responsive parameter may include motion, humidity, and/or temperature. Optionally, the geographical location may be input by a wearer. In another configuration, the geographical location may be determined using GPS. The adjustment system may include at least one of a humidity sensor, a temperature sensor, and an accelerometer in communication with the control module, the at least one of the humidity sensor, the temperature sensor, and the accelerometer operable to provide the control module with a condition-responsive parameter. The control module may be operable to translate the compressible component between the relaxed state and the constricted state in response to the condition-responsive parameter. In one configuration, the adjustment system may include an RFID reader associated with the control module, the control module may be operable to translate the compressible component between the relaxed state and the constricted state based on data received by the RFID reader. An RFID tag may be associated with the secondary wearable article, the RFID tag may be in communication with the RFID reader and operable to provide the data to the RFID reader. Optionally, the adjustment system may include a controller in communication with the control module and operable to display a status of the compressible component.

Figure 1B:
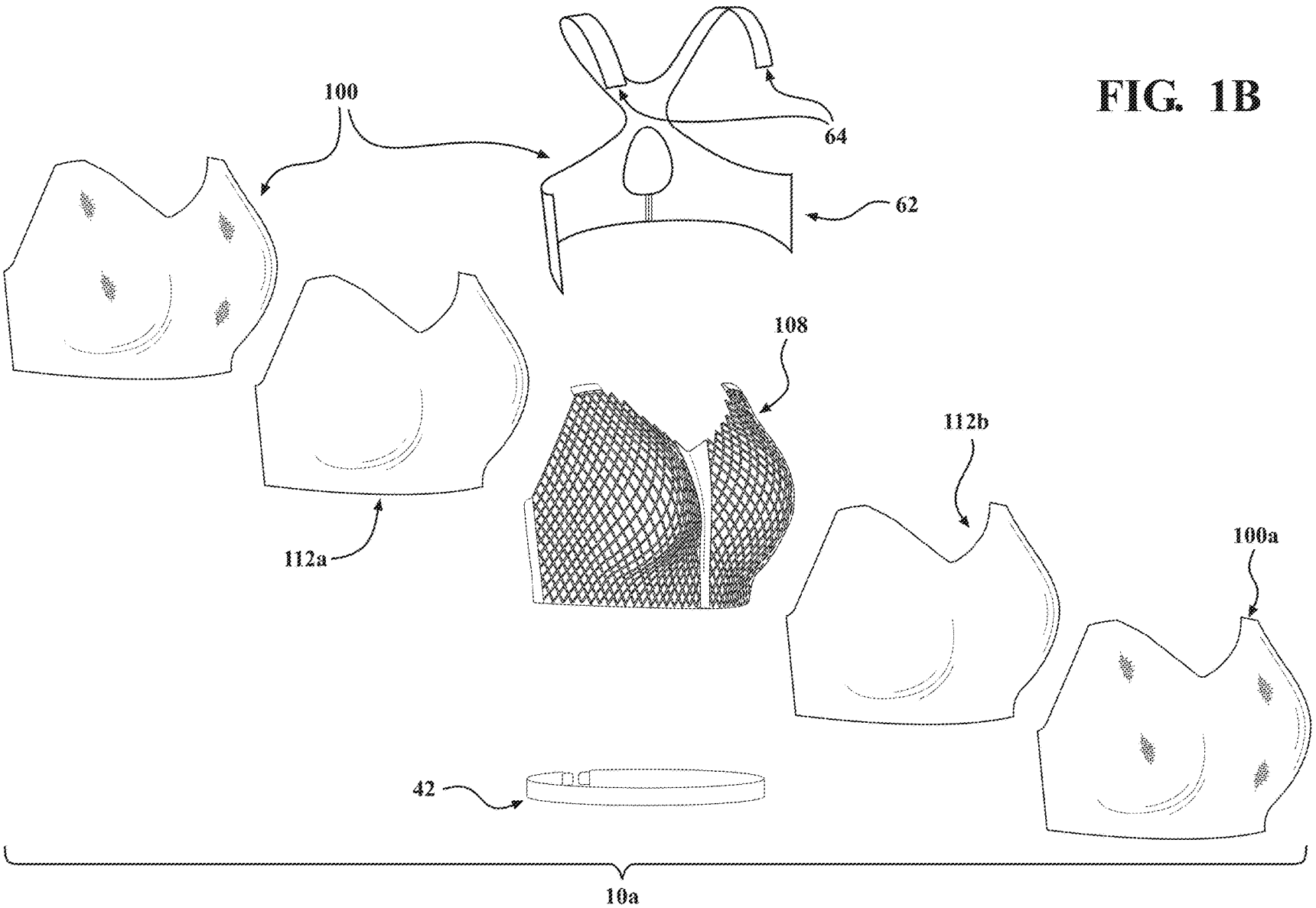
FIG. 1B is an exploded view of the article of apparel of FIG. 1A.
Figure 2:
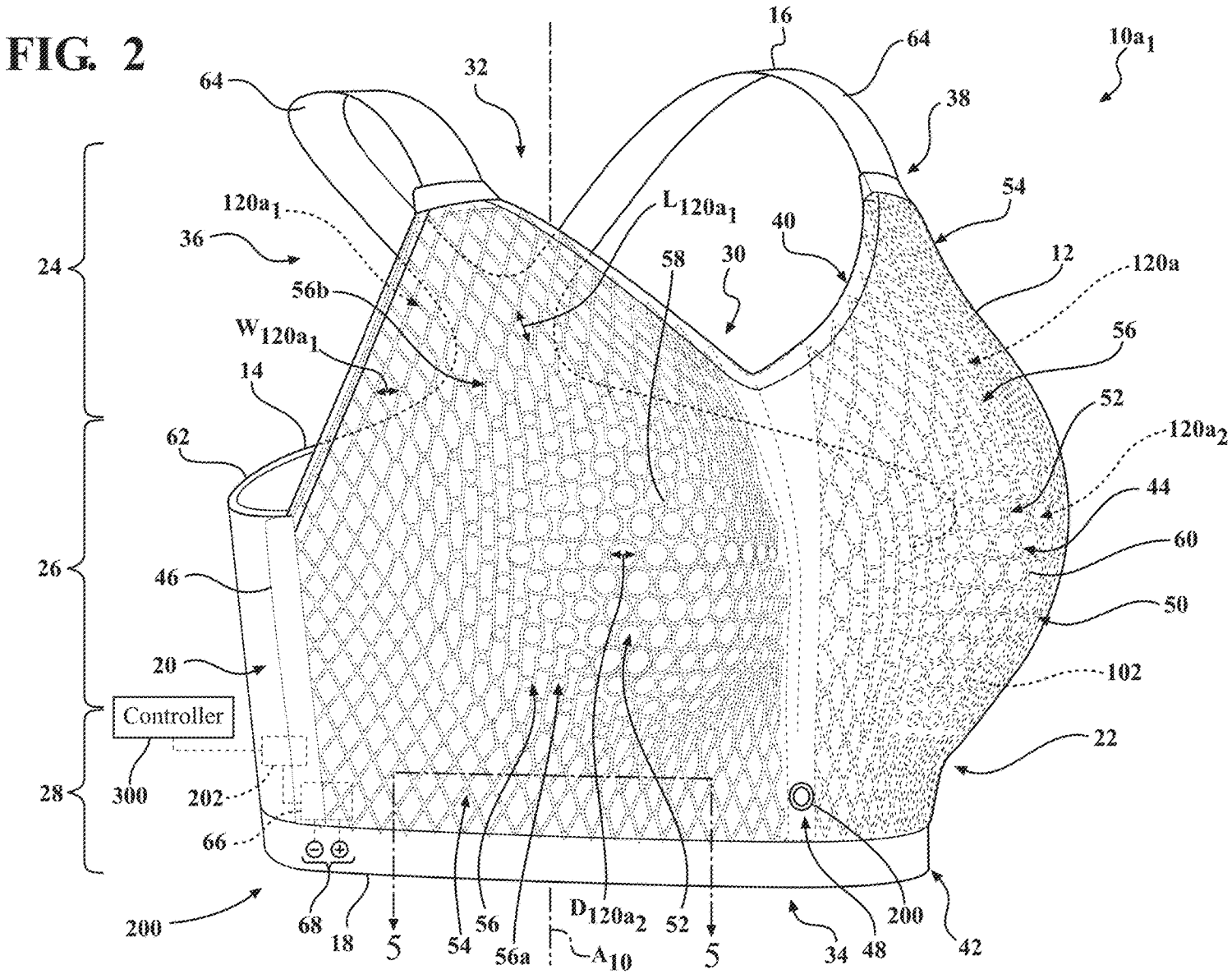
FIG. 2 is a perspective view of another example of an article of apparel according to the present disclosure.
Figure 10:
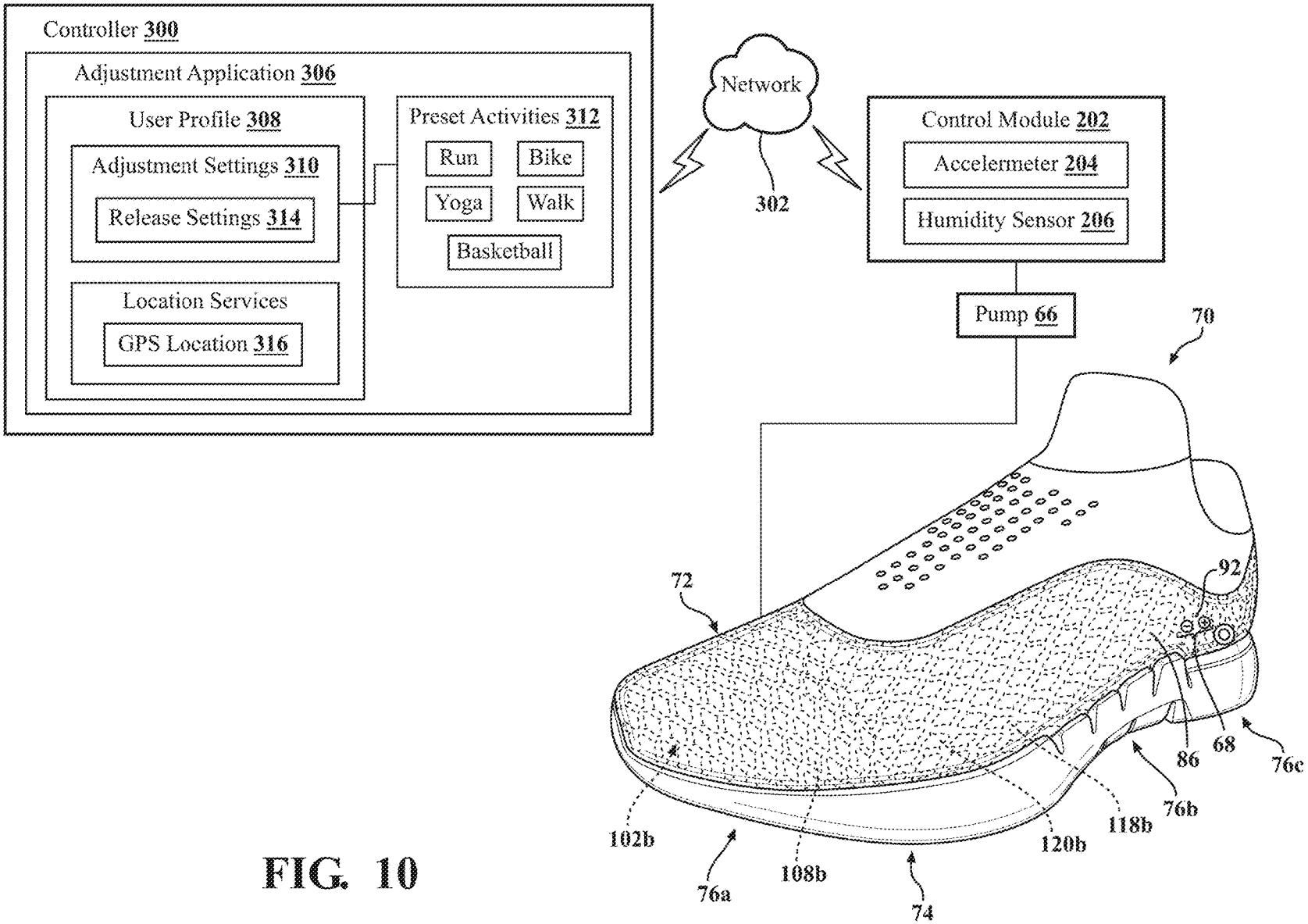
FIG. 10 is a schematic of an article of footwear of the present disclosure with a control module configured with an accelerometer and a humidity sensor, where the control module is in communication with a controller including an adjustment application.

Referring to FIGS. 1A-3, a plurality of articles of apparel 10 and a plurality of articles of footwear 70 may be configured as part of an adjustment system 200. The articles of apparel 10 include, at least, an upper-torso article of apparel 10*a* and a secondary article of apparel 10*b* (FIG. 10). It is contemplated that the articles of apparel 10 may include any number of articles including, but not limited to, the upper-torso article of apparel 10*a* and the secondary article of apparel 10*b*. The upper-torso article of apparel 10*a* is illustrated in FIG. 1A and includes any garment configured to cover an upper-torso of a wearer. The illustrated upper-torso article of apparel 10*a* includes a bra 10*a*, however the bra 10*a* may include other types of garments for a male or female, including a strapless bra, a camisole, a base-layer shirt, a singlet, swimwear, sports bra, or other garments with built-in support. FIG. 2 depicts another example of a configuration of a bra 10$a_1$. In view of the substantial similarity in structure and function of the components associated with the bra 10$a_1$ with respect to the bra 10*a*, like reference numerals are used hereinafter and in the drawings to identify like components while like reference numerals containing subscript extensions are used to identify those components that have been modified. The secondary article of apparel 10*b* (FIG. 10) and footwear 70 (FIG. 3) may be paired with the bras 10*a*, 10$a_1$ during an activity, which may result in adjustment of the bras 10*a*, 10$a_1$, as described in more detail below. For example, the secondary article of apparel 10*b* may include, but is not limited to a shirt, a tank top, a sweat band, shorts, a sweatshirt, a jacket, pants, or other types of garments that may be utilized by the wearer during an activity, as described in more detail below.

Referring to FIGS. 1A-2, the bras 10*a*, 10$a_1$ each may include an anterior side 12 associated with the front of the body of a wearer when the bras 10*a*, 10$a_1$ are in use, and a posterior side 14 associated with the back of the body of a wearer when the bras 10*a*, 10$a_1$ are in use. The bras 10*a*, 10$a_1$ may further include an upper end 16 configured to receive the shoulders of the wearer, and a lower end 18 configured to receive the ribcage of a wearer. A longitudinal axis $A_{10}$ of the bras 10*a*, 10$a_1$ extends along a height of the bras 10*a*, 10$a_1$ from the upper end 16 to the lower end 18 perpendicular to a ground surface, and generally divides the bras 10*a*, 10$a_1$ into a right side 20 and a left side 22. Accordingly, the right side 20 and the left side 22 respectively correspond with opposite sides of the bras 10*a*, 10$a_1$ and extend from the upper end 16 to the lower end 18. As used herein, a longitudinal direction refers to the direction extending from the upper end 16 to the lower end 18, while a sagittal direction refers to the direction transverse to the longitudinal direction and extending from the anterior side 12 to the posterior side 14. A frontal axis or direction refers to the direction extending from the right side 20 to the left side 22.

The bras 10*a*, 10$a_1$ may be divided into one or more regions. The regions may include a shoulder region 24, a chest region 26, and a ribcage region 28. The shoulder region 24 is associated with the clavicle and scapula bones of a shoulder. The chest region 26 may correspond with the true ribs and breast tissue area of an upper-torso, and the ribcage region 28 may correspond with the false and floating ribs of an upper-torso.

The bras 10*a*, 10$a_1$ further include an interior cavity 30, a neck-receiving opening 32, a torso-receiving opening 34, a right arm-receiving opening 36, and a left arm-receiving opening 38. As shown in FIGS. 1A and 2, the neck-receiving opening 32 is formed on the upper end 16 of the bras 10*a*, 10$a_1$ and the torso-receiving opening 34 is formed on the lower end 18 of the bras 10*a*, 10$a_1$. The neck-receiving opening 32 is further formed by a neckline 40 extending along a perimeter of the neck-receiving opening 32. Similarly, the torso-receiving opening 34 is further formed by a band 42 extending along a perimeter of the torso-receiving opening 34. While the band 42 is illustrated as including a clasp (FIG. 1B), it may alternatively be circumferentially connected at the lower end 18 by an elastic band.

The bras 10*a*, 10$a_1$, and components thereof, may be further described as including various subcomponents or regions. For example, the bras 10*a*, 10$a_1$ include a front panel 44 having a right panel 46 disposed at the anterior side 12 and extending from the shoulder and chest regions 24, 26 to the ribcage region 28 and from the right side 20 to a center bridge 48 disposed between the right side 20 and the left side 22. The front panel 44 further includes a left panel 50 disposed at the anterior side 12 and extending from the chest region 26 to the ribcage region 28 and from the left side 22 toward the center bridge 48.

The right panel 46 and the left panel 50 each further includes a central cup region 52 associated with the bust line of the wearer, a perimeter cup region 54 disposed around the perimeter of the right and left panels 46, 50, and a transition region 56 disposed between the central cup region 52 and the perimeter cup region 54. A first cup 58 and a second cup 60 of the bras 10*a*, 10$a_1$ are disposed within the central cup region 52 and extend to a respective apex. Each of the first cup 58 and the second cup 60 includes a generally convex shape to accommodate and provide support for the chest of the wearer while in-use. The central cup region 52 includes a generally convex shape to accommodate and provide support for the chest of the wearer while in-use.

The transition region 56 of the front panel 44 may include a bottom region 56*a* disposed around a bottom portion of the central cup region 52 and proximate to the lower end 18 of the bras 10*a*, 10$a_1$ and an upper region 56*b* disposed around an upper portion of the central cup region 52 and neckline 40 of the bras 10*a*, 10$a_1$. More specifically, the upper region 56*b* refers to the portion of each panel 46, 50 that extends upwardly from a respective one of the cups 58, 60 and corresponds to an upper bust area of the wearer, while the bottom region 56*a* refers to the portion of each panel 46, 50 that extends downwardly from a respective one of the cups 58, 60 and corresponds to the under bust of the wearer. The bra 10*a* illustrated in FIG. 1A further includes an adjustment element 102 operable to move between a relaxed state and a constricted state. The bra 10$a_1$ illustrated in FIG. 2 includes another example of an adjustment element 102*a*, described below, that cooperates with the perimeter cup and transition regions 54, 56 to expand and contract the bra 10$a_1$, while the central cup region 52 may remain generally passive. Stated differently, the perimeter cup and transition regions 54, 56 of the bra 10$a_1$ may compress about the wearer to provide structural support for the upper torso of the wearer, while the passive condition of the central cup region 52 minimizes compressive engagement of sensitive portions of the upper torso of the wearer. In view of the substantial similarity in structure and function of the components associated with the adjustment element 102 with respect to the adjustment element 102*a*, like reference numerals are used hereinafter and in the drawings to identify like components while like reference numerals containing letter extensions are used to identify those components that have been modified.

The bras 10*a*, 10$a_1$ may further include a back panel 62 and a pair of straps 64, extending between the anterior side 12 and the posterior side 14 of the bras 10*a*, 10$a_1$. The back panel 62 wraps across the posterior side 14 from the right side 20 to the left side 22, and includes a height that tapers in a direction from the straps 64 to the respective right side 20 and left side 22. The pair of straps 64 extend from the back panel 62 and generally form a "T" or "Y" shape and, further, extend over the shoulders of the wearer and connect to the right panel 46 and the left panel 50 at the anterior side 12 of the bras 10*a*, $10a_1$. The bras 10*a*, $10a_1$ may also include a pump 66 integrated or otherwise coupled to the bras 10*a*, $10a_1$ to translate the bras 10*a*, $10a_1$ between the relaxed state and the constricted state. As described in more detail below, the pump 66 may be activated via the adjustment system 200 and/or via actuators 68 incorporated with the bras 10*a*, $10a_1$.

With reference to FIG. 1B, the bra 10*a* may include a lining 100 opposing a wearer during use and at least partially forming the interior cavity 30 (FIG. 1A). Although described with respect to the bra 10*a*, the bra $10a_1$ may also include the lining 100, as described herein. It is contemplated that the lining 100 may be incorporated as part of the front panel 44 and/or the back panel 62 (FIG. 1A). Additionally or alternatively, the lining 100 may also be incorporated in other portions of the bra 10*a* including, but not limited to, the straps 64, the center bridge 48, and/or the band 42. The lining 100 may be formed from one or more materials that are coupled together. For example, the materials of the lining 100 may be stitched or adhesively bonded together. Suitable materials of the lining 100 may include, but are not limited to stretch woven fabric, knit fabric, non-woven fabric, and/or a composite construction. Moreover, the lining 100 may possess moisture-management characteristics such as wicking, breathability, fast-drying times, and other similar characteristics. The lining 100 may include a combination of one or more substantially inelastic or non-stretchable materials and one or more substantially elastic or stretchable materials disposed in different regions of the bra 10*a* to facilitate movement of the bra 10*a* between a tightened state and a loosened state. The one or more elastic materials may include any combination of one or more elastic fabrics such as, without limitation, spandex, elastane, rubber, or neoprene. The one or more inelastic materials may include any combination of one or more of thermoplastic polyurethanes, nylon, leather, vinyl, or another material/fabric that does not impart properties of elasticity. Accordingly, the lining 100 may stretch, thereby allowing the bra 10*a* to stretch around the upper-torso to be easily donned and doffed.

Figure 3:
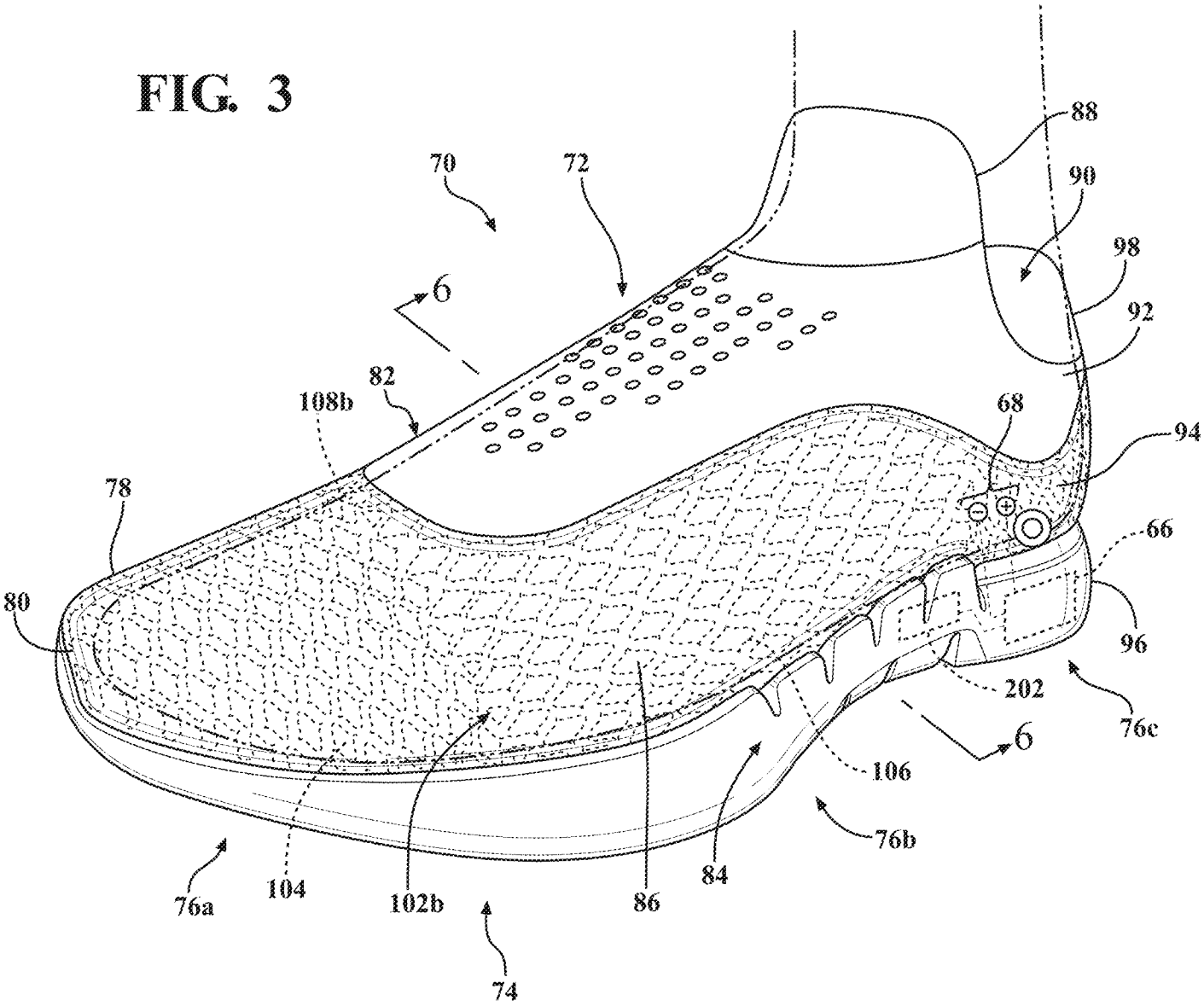
FIG. 3 is a perspective view of an article of footwear according to the present disclosure.

Referring to FIG. 3, the article of footwear 70 includes an upper 72 and a sole structure 74. The footwear 70 is depicted as an enclosed athletic shoe, such as a tennis, basketball, and/or running shoe. However, it is also contemplated that the article of footwear 70 may include a sandal, such as a slide having a strap that extends across a foot of the wearer. The article of footwear 70 may be divided into one or more regions. The regions may include a forefoot region 76*a*, a mid-foot region 76*b*, and a heel region 76*c*. The forefoot region 76*a* is associated with phalanges and metatarsal bones of a foot. The mid-foot region 76*b* may correspond with an arch area of the foot, and the heel region 76*c* may correspond with rear portions of the foot, including a calcaneus bone.

The upper 72 includes interior surfaces that define an interior space configured to receive and secure a foot for support on the sole structure 74. The upper 72, and components thereof, may be described as including various subcomponents or regions. For example, the upper 72 includes a toe cap 78 disposed at an anterior end 80 and extending over the toes from a medial side 82 to a lateral side 84. A pair of quarter panels 86 extend from the toe cap 78 in the mid-foot region 76*b* on opposite sides of the upper 72. A throat 88 extends across the top of the upper 72 and includes an instep region extending between the quarter panels 86 from the toe cap 78 to an ankle opening 90. In the illustrated example, the throat 88 is enclosed, whereby a material panel extends between the opposing quarter panels 86 in the instep region to cover the interior space. Here, the material panel covering the throat 88 may optionally be formed of a material having a higher modulus of elasticity than the material forming the quarter panels 86.

The upper 72 of the article of footwear 70 may be further described as including heel side panels 92 extending through the heel region 76*c* along the medial and lateral sides 82, 84 of the ankle opening 90. A heel counter 94 may be included and wraps around a posterior end 96 of the footwear 70 and connects the heel side panels 92. Uppermost edges of the throat 88, the heel side panels 92, and the heel counter 94 cooperate to form a collar 98, which includes the ankle opening 90 of the interior space.

The upper 72 may be formed from one or more materials that are stitched or adhesively bonded together to form the interior space. Suitable materials of the upper 72 may include, but are not limited to, mesh textiles, foam, leather, and synthetic leather. The materials may be selected and located to impart properties of durability, air-permeability, wear-resistance, flexibility, and comfort. The example upper 72 may be formed as an inner liner including a combination of one or more substantially inelastic or non-stretchable materials and/or one or more substantially elastic or stretchable materials disposed in different regions of the upper 72 to facilitate movement of the article of footwear 70 between a tightened state and a loosened state. The one or more elastic materials may include any combination of one or more elastic fabrics such as, without limitation, spandex, elastane, rubber, or neoprene. The one or more inelastic materials may include any combination of one or more thermoplastic polyurethanes, nylon, leather, vinyl, or another material/fabric that does not impart properties of elasticity. The footwear 70 may also include the pump 66 and actuators 68, mentioned above, to translate the upper 72 between a relaxed state and a compressed or constricted state, as described in more detail below. As illustrated in FIG. 3, the pump 66 may be integrated in the sole structure 74 of the footwear 70 with the actuators 68 disposed along the heel side panels 92. It is contemplated that in other implementations, the actuators 68 may be disposed at any practicable location along the upper 72 or sole structure 74 of the footwear 70.

Referring to FIGS. 1A-6B, the articles of apparel 10 and footwear 70 are each configured with an adjustment element 102-102*b*. In some implementations, the adjustment element 102 may be incorporated into the front panel 44 of the bra 10*a* and may be attached to the lining 100. In some implementations, the bra 10*a* further includes an additional outer layer or shell 100*a* attached to the lining 100 to enclose the adjustment element 102 between the lining 100 and the shell 100*a*. In other implementations, an adjustment element 102*b* may be incorporated and attached to the upper 72 of the footwear 70.

The adjustment element 102 includes a bladder 104 forming an interior void 106 having a compressible component or infill 108 disposed therein. As described in more detail below, the compressible component 108 includes a first surface 110*a* on a first side of the compressible component 108 and a second surface 110*b* on an opposite second side of the compressible component 108. A distance from the first surface 110*a* to the second surface 110*b* defines a thickness $T_{108}$ of the compressible component 108. For example, the thickness $T_{108}$ of the compressible component 108 may be approximately six (6) millimeters. It is also contemplated that the compressible component 108 may have a thickness ranging from approximately two (2) millimeters to approximately ten (10) millimeters. Alternatively, the thickness $T_{108}$ may be equal to or less than two (2) millimeters or greater than or equal to ten (10) millimeters. Additionally or alternatively, the compressible component 108 may have a varied thickness $T_{108}$ across the compressible component 108. Finally, while the compressible component 108 is described as having a thickness in the foregoing ranges, the thickness of the compressible component 108 may be dependent on the material used.

The adjustment element 102 includes an inner barrier layer 112*a* and an outer barrier layer 112*b* forming at least a portion of the articles 10, 70. Interior surfaces of the barrier layers 112*a*, 112*b* face each other and are joined to each other to form a peripheral seam 114 that surrounds the interior void 106 to form a chamber 116 of the bladder 104. As used herein, the term "barrier layer" (e.g., barrier layers 112*a*, 112*b*) encompasses both monolayer and multilayer films. In some configurations, one or both of barrier layers 112*a*, 112*b* are produced (e.g., thermoformed or blow molded) from a monolayer film (a single layer). In other configurations, one or both of the barrier layers 112*a*, 112*b* are produced (e.g., thermoformed or blow molded) from a multilayer film (multiple sublayers). In either aspect, each layer or sublayer can have a film thickness ranging from approximately 0.2 micrometers to approximately 1 millimeter. In further configurations, the film thickness for each layer or sublayer can range from approximately 0.5 micrometers to approximately 500 micrometers. In yet further configurations, the film thickness for each layer or sublayer can range from approximately 1 micrometer to approximately 100 micrometers.

One or both of the barrier layers 112*a*, 112*b* can independently be transparent, translucent, and/or opaque. As used herein, the term "transparent" for a barrier layer means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 112*a*, 112*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like. In one example, one or both of the barrier layers 112*a*, 112*b* may include a film disposed along an outer surface of the barrier layer(s) 112*a*, 112*b* or that forms the barrier layer(s) 112*a*, 112*b*. The film may optionally be configured to tactically correspond to a textile that has the look and/or feel of a textile in terms of appearance and/or stretchability but is able to contain a fluid with the bladder 104. The film may assist in fluid flow along the barrier layer(s) 112*a*, 112*b* while cooperating to retain fluid within the bra 10*a*.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some configurations, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 112*a*, 112*b* may include two or more sublayers (multilayer film), such that two sheets of the multilayer film may be placed on top of each other and welded together along selected points using conventional heat sealing techniques of radiofrequency (RF) welding techniques to form an interior compartment. In configurations where the barrier layers 112*a*, 112*b* include two or more sublayers, examples of suitable multilayer films include microlayer films, for example a microlayer polymeric composite including at least approximately 10 layers and may range between at least approximately 10 layers to at least approximately 50 layers and/or microlayer elastomer membranes including at least approximately 10 to approximately 1000 layers. The average thickness of each individual layer may be as low as a few nanometers to as high as several mils (approximately 100 microns) thick. In further configurations, barrier layers 112*a*, 112*b* may each independently include alternating sublayers of one or more TPU copolymer materials and one or more EVOH copolymer materials, where the total number of sublayers in each of the barrier layers 112*a*, 112*b* includes at least four (4) sublayers, at least ten (10) sublayers, at least twenty (20) sublayers, at least forty (40) sublayers, and/or at least sixty (60) sublayers.

The chamber 116 can be produced from the barrier layers 112*a*, 112*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 112*a*, 112*b* can be produced by co-extrusion followed by vacuum thermoforming to produce the chamber 116.

The chamber 116 desirably has a low gas transmission rate. In some configurations, the chamber 116 has a gas transmission rate for nitrogen gas that is at least approximately ten (10) times lower than a nitrogen gas transmission rate for a butyl rubber layer of substantially the same dimensions. In an aspect, the chamber 116 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 112*a*, 112*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the inner barrier layer 112*a* and the outer barrier layer 112*b* cooperate to form a geometry (e.g., thicknesses, width, and lengths) of the chamber 116. The peripheral seam 114 may extend around the chamber 116 to seal the chamber 116 and allow a vacuum to be applied to the chamber 116. Thus, the chamber 116 is associated with an area of the bladder 104 where interior surfaces of the upper and lower barrier layers 112*a*, 112*b* are not joined together and, thus, are separated from one another. The compressible component 108 is received within the chamber 116 in areas where the barrier layers 112*a*, 112*b* are not joined together. Finally, while the peripheral seam 114 is described and shown as sealing the chamber 116, the peripheral seam 114 may also be used to attach the lining 100 and/or upper 72 to the bladder 104. Namely, a material forming the lining 100 and/or the upper 72 may be fused to a material forming the barrier layer(s) 112*a*, 112*b* when the peripheral seam 114 is formed by causing a material of one or more of the barrier layers 112*a*, 112*b* to flow and, thus, bond to a material of the lining 100 and/or upper 72.

In some examples, the barrier layers 112*a*, 112*b* may include the same materials to provide the chamber 116 with a homogenous barrier construction, such that both sides of the adjustment element 102 will contract and relax at the same rate when pressure within the chamber 116 is adjusted. Alternatively, a first one of the barrier layers 112*a*, 112*b* may be at least partially constructed of a different barrier material and/or configuration than the other one of the barrier layers 112*a*, 112*b* to selectively impart a contour as the adjustment element 102 transitions between the relaxed state and the contracted state. For example, one of the barrier layers 112*a*, 112*b* may be at least partially formed with a different modulus of elasticity and/or stiffness than the other barrier layer 112*a*, 112*b*, such that when the adjustment element 102 transitions from the relaxed state to the constricted state, the first one of the barrier layers 112*a*, 112*b* contracts at a different rate than the other barrier layer 112*a*, 112*b* to cause the adjustment element 102 to curl.

Figure 4A:
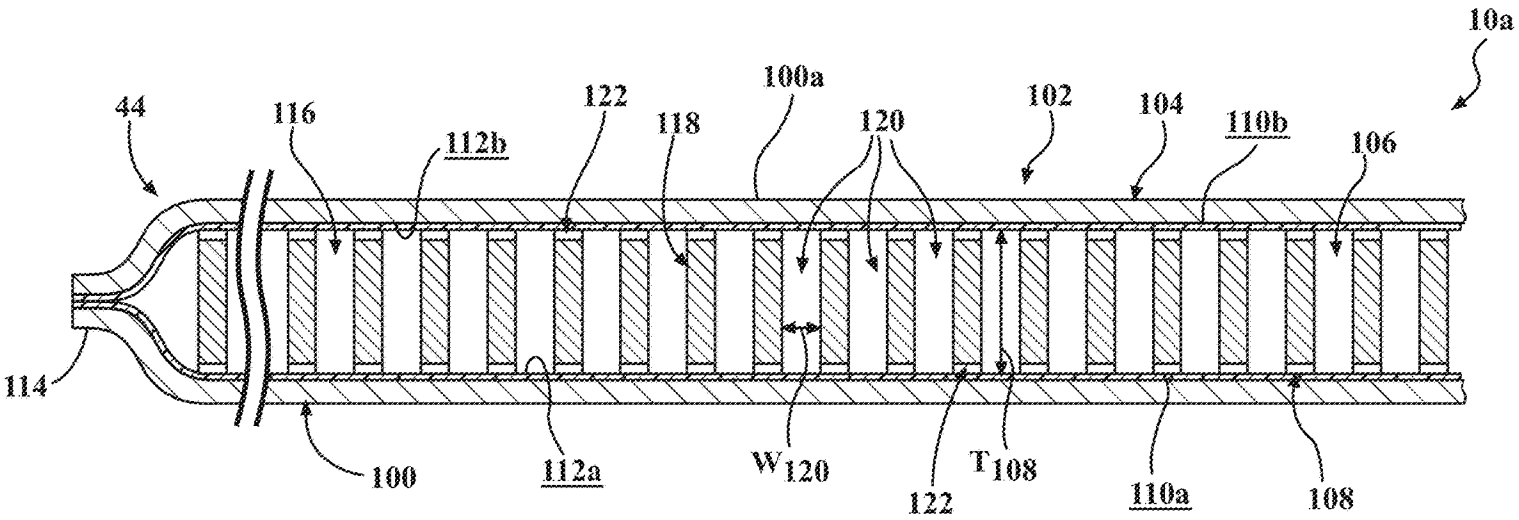
FIG. 4A is a cross-sectional view of the article of apparel of FIG. 1A, taken along Line 4-4 in FIG. 1, where the article of apparel is in a relaxed state.
Figure 4B:
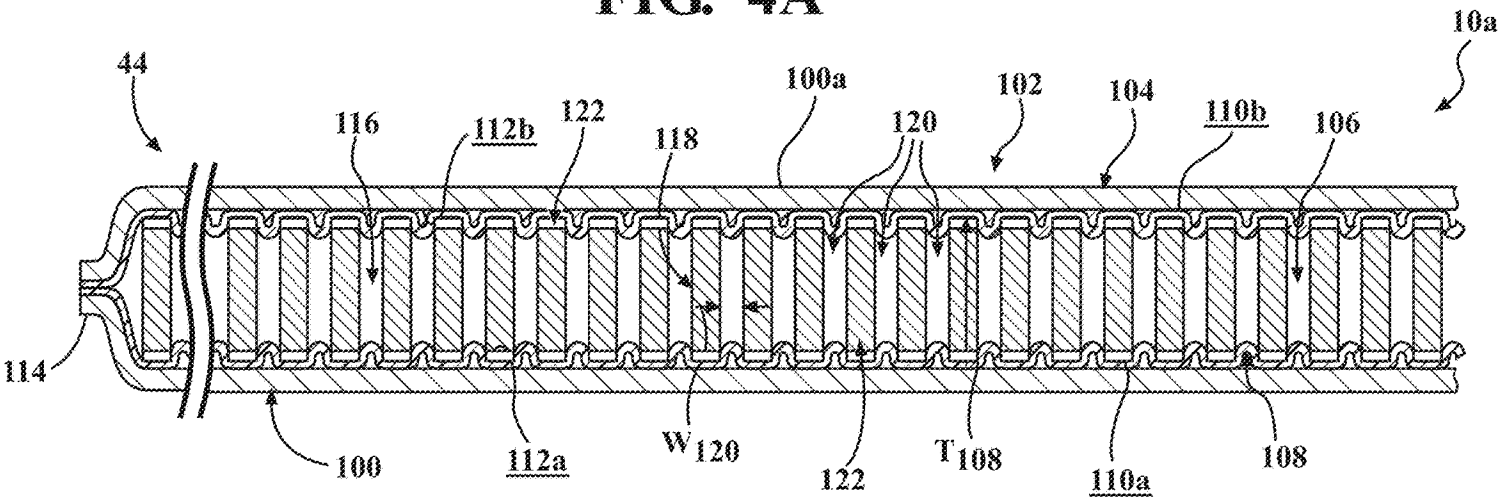
FIG. 4B is a cross-sectional view of the article of apparel of FIG. 1A, taken along Line 4-4 in FIG. 1, where the article of apparel is in a constricted state.

Continuing with reference to FIGS. 4A and 4B, the compressible component 108 forms a transformable structure that selectively moves the articles 10, 70 between the relaxed state and the constricted state. The first surface 110*a* of the compressible component 108 faces the inner barrier layer 112*a* and the second surface 110*b* faces the outer barrier layer 112*b*. In this example, the compressible component 108 includes a collapsible lattice structure 118 having a plurality of apertures or reliefs 120, described in more detail below, formed through the thickness $T_{108}$ (i.e., direction from the inner barrier layer 112*a* to the outer barrier layer 112*b*) of the compressible component 108. The compressible component 108 may be cut flat to optionally form an outline of the compressible component 108 and/or the reliefs 120. In one example, the compressible component 108 may be laser cut to form the reliefs 120, such that the heat from the laser may provide a sealing skin along the reliefs 120 to advantageously improve the structural integrity of the compressible component 108. The compressible component 108 may be subsequently thermoformed. The compressible component 108 may then be disposed within the interior void 106 of the adjustment element 102. Alternatively, the compressible component 108 may be injection molded prior to being positioned within the interior void 106. Generally, when a pressure within the chamber 116 is reduced, the lattice structure 118 collapses within the chamber 116 to transition the adjustment element 102 and the bra 10*a* from the relaxed or expanded state to the constricted state.

Referring still to FIGS. 4A and 4B, the adjustment element 102 may also include a plurality of channels 122 etched or otherwise disposed along the lattice structure 118 to promote fluid circulation within the chamber 116. In one example, the channels 122 may extend a partial width of the relief 120, such that each channel 122 may be less than a width and/or thickness of the respective relief 120. By way of example, not limitation, the channels 122 may be configured as wells having a dimension of approximately 0.5 millimeters by approximately 0.5 millimeters along the barrier layers 112*a*, 112*b*. The channels 122 may be positioned along the first and/or second surface 110*a*, 110*b* and include a fluid path within the chamber 116. For example, the channels 122 may extend between the reliefs 120 to fluidly connect each of the reliefs 120. It is also contemplated that the channels 122 may extend around a periphery of the compressible component 108 to provide peripheral fluid paths and promote airflow and circulation within the chamber 116. In one example, the channels 122 may be formed using a laser etching process prior to thermoforming the compressible component 108. The laser etching process may form the channels 122 into the compressible component 108 and, as a result, promote fluid flow within the bra 10*a* by increasing fluid circulation between the reliefs 120. For example, as mentioned below, the compressible component 108 may include an elastomeric material, such as an ethylene-vinyl acetate foam (EVA), such that the channels 122 provide fluid flow through an otherwise non-porous material.

Figure 5A:
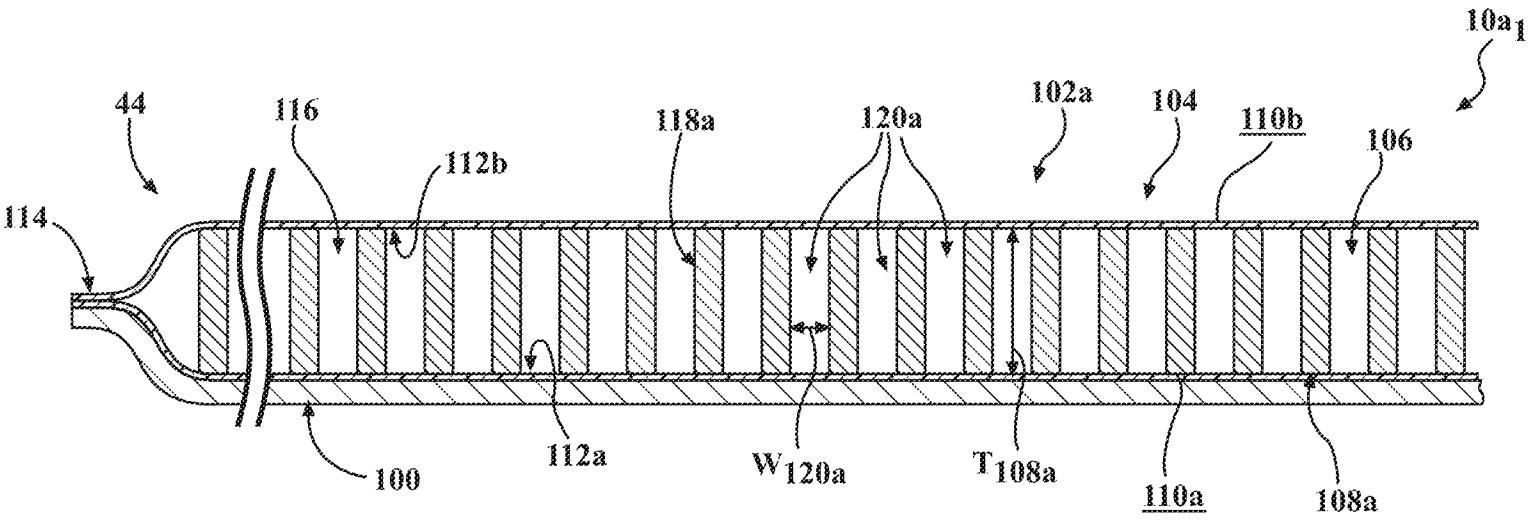
FIG. 5A is a cross-sectional view of the article of apparel of FIG. 2, taken along Line 5-5 in FIG. 2, where the article of apparel is in a relaxed state.
Figure 5B:
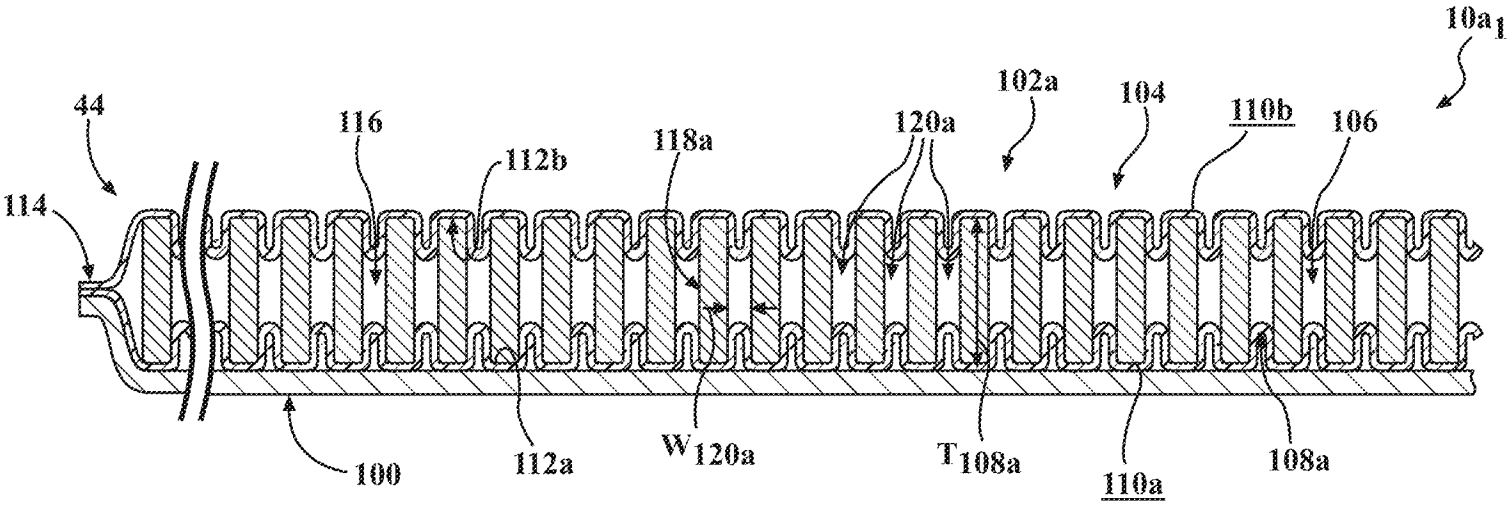
FIG. 5B is a cross-sectional view of the article of apparel of FIG. 2, taken along Line 5-5 in FIG. 2, where the article of apparel is in a constricted state.

FIGS. 5A and 5B illustrate a cross-sectional view of an example of an adjustment element 102*a* transitioning from the relaxed state (FIG. 5A) to the constricted state (FIG. 5B) taken along Line 5-5 of FIG. 2. In view of the substantial similarity in structure and function of the components associated with the adjustment element 102, like reference numerals are used hereinafter and in the drawings to identify like components while like reference numerals containing letter extensions are used to identify those components that have been modified.

The adjustment element 102*a* may be integrated in the front panel 44 of the bra $10a_1$ (FIG. 2) and includes a bladder 104 forming an interior void 106 having a compressible component or infill 108*a* disposed therein. As shown in FIG. 5A, the compressible component 108*a* includes a first surface 110*a* on a first side of the compressible component 108*a* and a second surface 110*b* on an opposite second side of the compressible component 108*a*. A distance from the first surface 110*a* to the second surface 110*b* defines a thickness $T_{108a}$ of the compressible component 108*a*. For example, the thickness $T_{108a}$ of the compressible component 108*a* may be approximately six (6) millimeters. It is also contemplated that the compressible component 108*a* may have a thickness ranging from approximately two (2) millimeters to approximately ten (10) millimeters. Alternatively, the thickness Tim may be equal to or less than two (2) millimeters or greater than or equal to ten (10) millimeters. Additionally or alternatively, the compressible component 108*a* may have a varied thickness $T_{108a}$ across the compressible component 108*a*. Finally, while the compressible component 108*a* is described as having a thickness in the foregoing ranges, the thickness of the compressible component 108*a* may be dependent on the material used. As discussed in greater detail below, the compressible component 108*a* selectively transitions the adjustment element 102*a* and the bra 10$a_1$ between a relaxed state and a constricted state to adjust a fit of the bra 10$a_1$ around a torso of a wearer.

In the illustrated examples, the adjustment element 102*a* includes an inner barrier layer 112*a* attached to a first surface of a lining 100, and an outer barrier layer 112*b* forming at least a portion of an exterior surface of the bra 10*a*. Interior surfaces of the barrier layers 112*a*, 112*b* face each other and are joined to each other to form a peripheral seam 114 that surrounds the interior void 106 to form a chamber 116 of the bladder 104.

In this example, the compressible component 108*a* includes a collapsible lattice structure 118*a* having a plurality of apertures or reliefs 120*a* formed through the thickness $T_{108a}$ (i.e., direction from the inner barrier layer 112*a* to the outer barrier layer 112*b*) of the compressible component 108*a*. The compressible component 108*a* may be cut flat to form an outline of the compressible component 108*a* and/or the reliefs 120*a*. The compressible component illustrated in FIGS. 5A and 5B is free from the channels 122, such that the lattice structure 118*a* of the compressible component 108*a* may be free from peripheral fluid paths. In this alternate configuration, it is contemplated that the compressible component 108*a* may be formed from a porous material that assists in fluid flow and circulation within the chamber 116. As the adjustment element 102*a* collapses (FIG. 5B), the outer barrier layer 112*b* may be drawn into the reliefs 120*a* towards the inner barrier layer 112*a*. Optionally, the outer barrier layer 112*b* may contact the inner barrier layer 112*a* such that friction between the inner barrier layer 112*a* and the outer barrier layer 112*b* causes the lining 100 of the front panel 44 to increase in stiffness when the adjustment element 102*a* is in the constricted state.

Figure 6A:
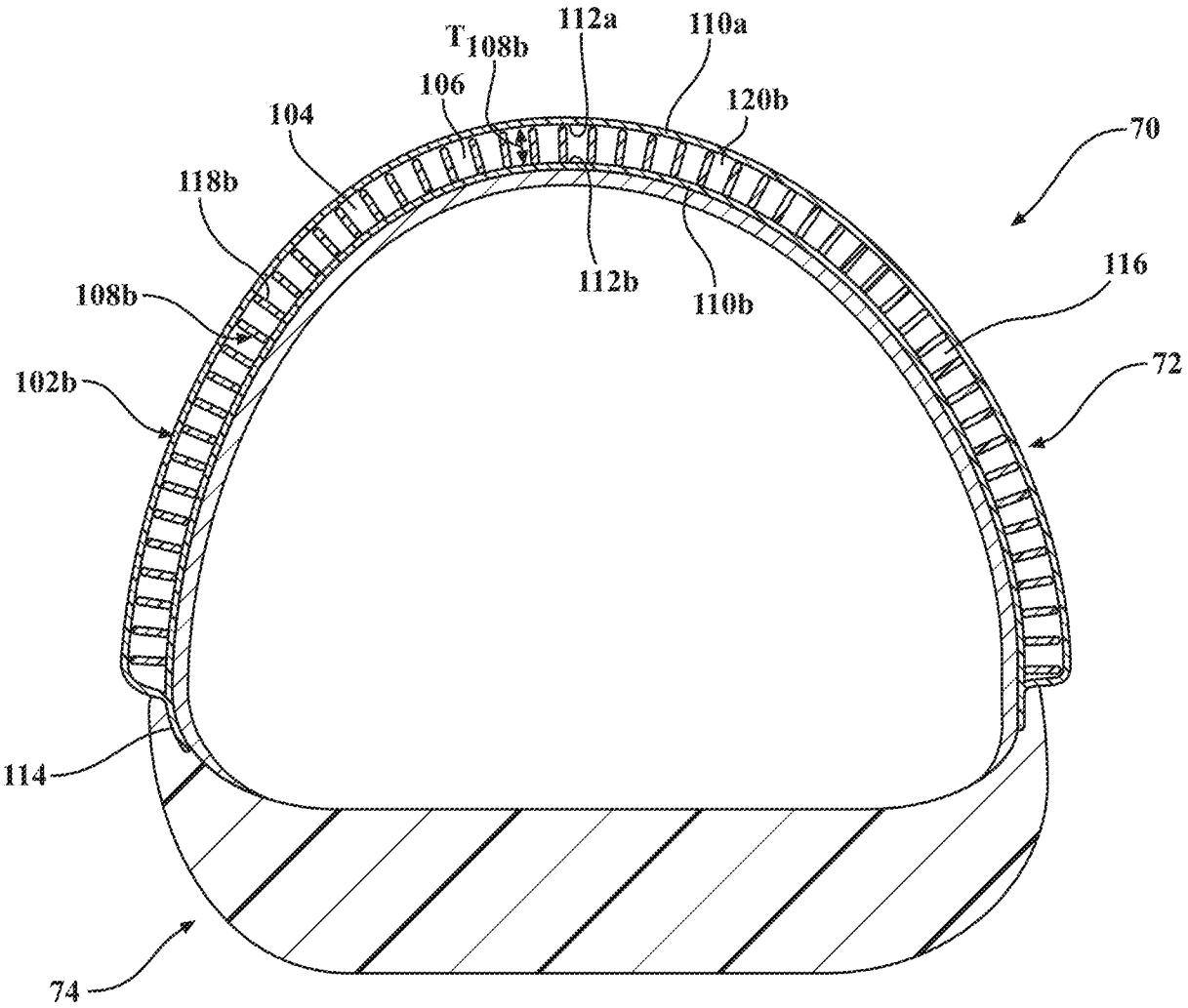
FIG. 6A is a cross-sectional view of the article of footwear of FIG. 3, taken along Line 6-6 in FIG. 3, where the article of footwear is in a relaxed state.
Figure 6B:
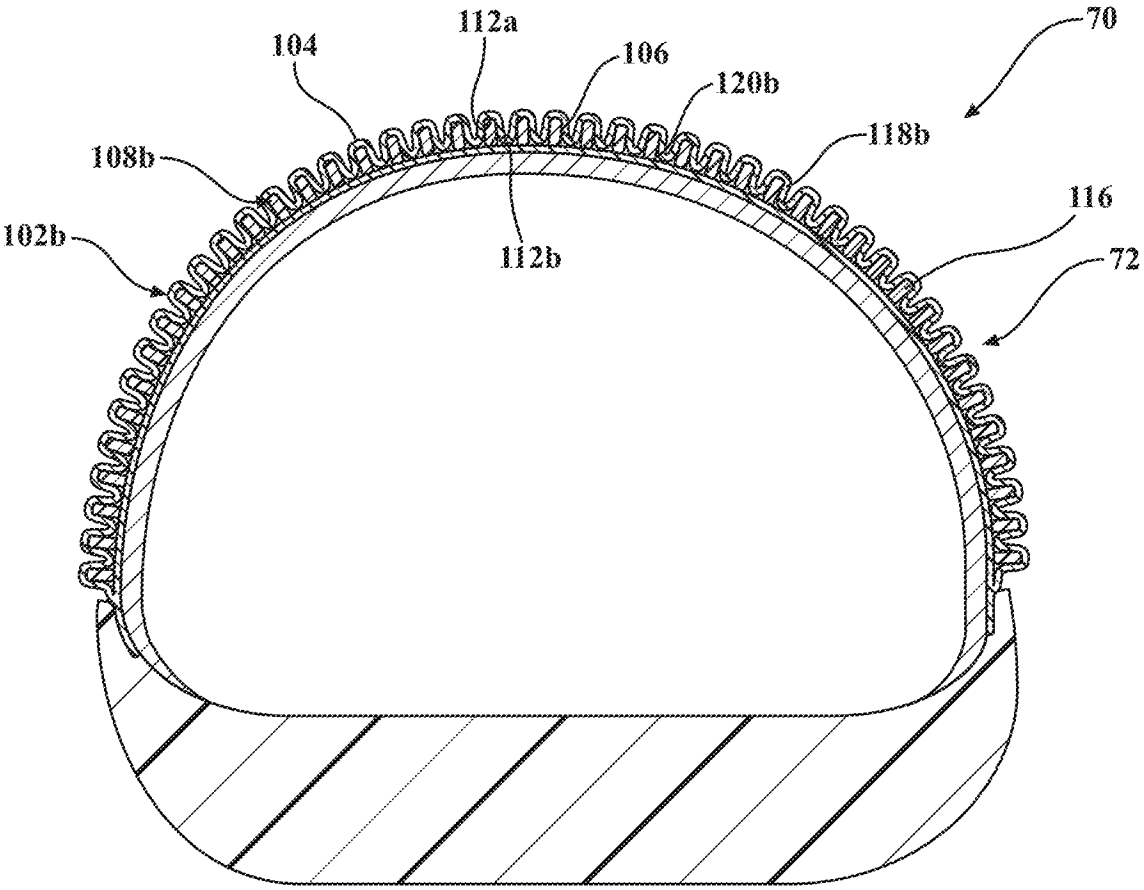
FIG. 6B is a cross-sectional view of the article of footwear of FIG. 3, taken along Line 6-6 in FIG. 3, where the article of footwear is in a constricted state.

FIGS. 6A and 6B illustrate a cross-sectional view of an example of an adjustment element 102*b* transitioning from the relaxed state (FIG. 6A) to the constricted state (FIG. 6B) taken along Line 6-6 of FIG. 3. In view of the substantial similarity in structure and function of the components associated with the adjustment element 102, like reference numerals are used hereinafter and in the drawings to identify like components while like reference numerals containing letter extensions are used to identify those components that have been modified.

The adjustment element 102*b* may be integrated in the upper 72 of the footwear 70 (FIG. 3) and includes a bladder 104 forming an interior void 106 having a compressible component or infill 108*b* disposed therein. As shown in FIG. 6A, the compressible component 108*b* includes a first surface 110*a* on a first side of the compressible component 108*b* and a second surface 110*b* on an opposite second side of the compressible component 108*b*. A distance from the first surface 110*a* to the second surface 110*b* has a thickness $T_{108b}$ of the compressible component 108*b*. For example, the thickness $T_{108b}$ of the compressible component 108*b* may be approximately six (6) millimeters. It is also contemplated that the compressible component 108*b* may have a thickness ranging from approximately two (2) millimeters to approximately ten (10) millimeters. Alternatively, the thickness $T_{108b}$ may be equal to or less than two (2) millimeters or greater than or equal to ten (10) millimeters. Additionally or alternatively, the compressible component 108*b* may have a varied thickness $T_{108b}$ across the compressible component 108*b*. Finally, while the compressible component 108*b* is described as having a thickness in the foregoing ranges, the thickness of the compressible component 108*b* may be dependent on the material used. As discussed in greater detail below, the compressible component 108*b* selectively transitions the adjustment element 102*b* and the footwear 70 between a relaxed state and a constricted state to adjust a fit of the footwear 70 around a foot of a wearer.

In the illustrated examples, the adjustment element 102*b* includes an inner barrier layer 112*a* attached to a first surface of the upper 72, and an outer barrier layer 112*b* forming at least a portion of an exterior surface of the footwear 70. Interior surfaces of the barrier layers 112*a*, 112*b* face each other and are joined to each other to form a peripheral seam 114 that surrounds the interior void 106 to form a chamber 116 of the bladder 104.

In this example, the compressible component 108*b* includes a collapsible lattice structure 118*b* having a plurality of apertures or reliefs 120*b* formed through the thickness Tim, (i.e., direction from the inner barrier layer 112*a* to the outer barrier layer 112*b*) of the compressible component 108*b*. The compressible component 108*b* may be cut flat to form an outline of the compressible component 108*b* and/or the reliefs 120*b*. The compressible component 108*b* illustrated in FIGS. 6A and 6B is free from the channels 122 (FIG. 4A), such that the lattice structure 118*b* of the compressible component 108*b* may be free from peripheral fluid paths. In this alternate configuration, it is contemplated that the compressible component 108*b* may be formed from a porous material that assists in fluid flow and circulation within the chamber 116. As the adjustment element 102*b* collapses (FIG. 6B), the outer barrier layer 112*b* may be drawn into the reliefs 120*b* towards the inner barrier layer 112*a*. Optionally, the outer barrier layer 112*b* may contact the inner barrier layer 112*a* such that friction between the inner barrier layer 112*a* and the outer barrier layer 112*b* causes the upper 72 to increase in stiffness when the adjustment element 102*b* is in the constricted state.

In operation, as the bra 10*a* and the footwear 70 are evacuated, the barrier layers 112*a*, 112*b* of each of the adjustment elements 102-102*b* are drawn against the compressible components 108-108*b* and are generally constricted as a result of a vacuum that is drawn. For example, as illustrated in FIGS. 4B, 5B, and 6B, the barrier layers 112*a*, 112*b* may be at least partially depressed within or otherwise at least partially disposed within the reliefs 120-120*b* defined by the lattice structures 118-118*b* as the vacuum is drawn and the compressible components 108-108*b* are translated into the contracted state. If the compressible component 108 includes channels 122 (FIG. 4A), the overall size and depth of the channels 122 is relatively small when compared to the size of the reliefs 120. As such, the barrier layers 112*a*, 112*b* may not meaningfully extend into the channels 122 when a vacuum is drawn and therefore depressions are not formed in the barrier layers 112*a*, 112*b* in the areas of the channels 122.

The lattice structures 118-118*b* of the compressible components 108-108*b* are constricted as the at least partial vacuum is drawn, such that the reliefs 120-120*b* may reduce in overall size to form a more rigid structure. The lattice structures 118-118*b* compress or are otherwise constricted to generally restrict a chest or foot of the wearer to minimize movement and provide advantageous compression. The lattice structures 118-118*b* also provide a three-dimensional structure that assists in the compressive movement as the compressible components 108-108*b* translate from the relaxed state to the constricted state. The multi-directional compression maximizes the amount of constriction and, thus, support for the wearer. Stated differently, the lattice structures 118-118*b* of the compressible components 108-108*b* advantageously translate along each of an x-axis and a y-axis to provide a maximum desired compressive force for the wearer, which assists in further supporting the wearer when the compressible components 108-108*b* are in the constricted state. As illustrated in FIGS. 4A-6B, while the overall size of the compressible components 108-108*b* and lattice structures 118-118*b* are compressed and reduced, it is contemplated that the individual reliefs 120-120*b* when configured as a diamond-shaped relief, may simultaneously shrink or otherwise be compressed along the x-axis (that is, short diagonal) and elongated along the y-axis (that is, long diagonal).

Referring again to FIGS. 4A and 4B, the compressible component 108 may be attached along a perimeter to the corresponding barrier layer 112*a*, 112*b* when the adjustment element 102 is assembled to form the peripheral seam 114 of the adjustment element 102. Stated differently, the surfaces 110*a*, 110*b* of the compressible component 108 may be attached to the barrier layer(s) 112*a*, 112*b* along the peripheral seam 114 to form the chamber 116 of the bladder 104, as mentioned above, while being otherwise generally free from attachment. As illustrated in FIG. 4B, it is contemplated that the surfaces 110*a*, 110*b* may be drawn toward the barrier layers 112*a*, 112*b* when the adjustment element 102 is compressed under vacuum. While the surfaces 110*a*, 110*b* may be proximate or otherwise engaged with the barrier layers 112*a*, 112*b* when the vacuum is drawn, the surfaces 110*a*, 110*b* may remain otherwise unattached relative to the barrier layers 112*a*, 112*b* at areas other than the peripheral seam 114. It is also contemplated that the surfaces 110*a*, 110*b* may be spot welded or bonded with the barrier layers 112*a*, 112*b* to form portions of the compressible component 108 that may be static or otherwise free from constriction as a result of the vacuum applied, as described with respect to FIGS. 7-14 below. Thus, as the vacuum is applied, the compressible component 108 moves from the relaxed state to the constricted state, and the barrier layers 112*a*, 112*b* also transition from the relaxed state to the constricted state. While the surfaces 110*a*, 110*b* may be attached to the barrier layers 112*a*, 112*b* at the peripheral seam 114, it is contemplated that the surfaces 110*a*, 110*b* may be otherwise unattached from the barrier layers 112*a*, 112*b* to provide fluid flow within the bladder 104 between the surfaces 110*a*, 110*b* and the barrier layers 112*a*, 112*b*. The adjustment element 102 may also include the channels 122, such that the barrier layers 112*a*, 112*b* have at least partial separation from the compressible component 108 even in the constricted state. The partial separation provided by the channels 122 between the barrier layers 112*a*, 112*b* and the compressible component 108 assists in fluid flow within the chamber 116.

One or both of the surfaces 110*a*, 110*b* of the compressible component 108 may be detached from the barrier layers 112*a*, 112*b*. In this configuration, one or both of the barrier layers 112*a*, 112*b* are free to move with respect to the surfaces 110*a*, 110*b* of the compressible component 108 as the compressible component 108 transitions between the relaxed state and the constricted state. For example, the barrier layers 112*a*, 112*b* are moved from the relaxed state to the constricted state when the barrier layers 112*a*, 112*b* are drawn into the reliefs 120, 120*a* under vacuum and are essentially pinched within the reliefs 120, 120*a*. In so doing, the pinched barrier layers 112*a*, 112*b* are essentially fixed for movement with the compressible component 108 due to being pinched within the reliefs 120, 120*a* and are transitioned into the constricted state along with the compressible component 108. When the vacuum is released, the resilient nature of the compressible component 108 returns the compressible component 108 to the relaxed or expanded state and, in so doing, exerts a force on the barrier layers 112*a*, 112*b*, thereby moving the barrier layers 112*a*, 112*b* from the constricted state to the relaxed or expanded state. The detachment or separation between the barrier layers 112*a*, 112*b* and the compressible component 108 may provide additional movement and flexibility of the bra 10*a* and/or footwear 70 while in the relaxed state while still causing movement of the barrier layers 112*a*, 112*b* along with the compressible component 108 when the compressible component 108 is moved between the relaxed and constricted states. In some configurations, one of the barrier layers 112*a*, 112*b* may be bonded to a corresponding surface 110*a*, 110*b* of the compressible component 108. During repeated contraction and relaxation, the outer and/or inner barrier layer 112*b*, 112*a* may not align with the corresponding surface 110*b*, 110*a* of the compressible component 108, which may cause a wrinkling appearance. In order to reduce movement of the outer barrier layer 112*b* or the inner barrier layer 112*a* with respect to the compressible component 108, the outer barrier layer 112*b* or the inner barrier layer 112*a* may be bonded to the compressible component 108. As a result, air flow through the plurality of channels occurs only via the side of the compressible component 108 that is not bonded to the barrier layer 112*a* or 112*b*.

In other implementations, at least one of the surfaces 110*a*, 110*b* of the compressible component 108 may be partially attached to the barrier layers 112*a*, 112*b*. For example, the compressible component 108 may be attached to the barrier layers 112*a*, 112*b* along a periphery of the surfaces 110*a*, 110*b* such that the interior region of the respective surface 110*a*, 110*b* is detached or independent from the barrier layers 112*a*, 112*b*. Thus, as the vacuum is applied and the compressible component 108 transitions from the relaxed state to the constricted state, the barrier layers 112*a*, 112*b* are influenced from the relaxed state to the constricted state under the applied vacuum by the outer periphery of the compressible component 108. For example, the barrier layers 112*a*, 112*b* may be attached to the compressible component 108 at the outer periphery or peripheral seam 114 of the compressible component 108. As such, when the vacuum is applied and the compressible component 108 translates toward the constricted state, the barrier layers 112*a*, 112*b* are drawn or otherwise compressed toward the compressible component 108 as a result of shrinkage or other compressive movement under vacuum of the outer periphery of the compressible component 108. Alternatively, at least one of the surfaces 110*a*, 110*b* of the compressible component 108 may be zonally attached to a respective one of the barrier layers 112*a*, 112*b*, which may then translate the surfaces 110*a*, 110*b* and the barrier layers 112*a*, 112*b* when the vacuum is drawn.

In FIG. 4A, the adjustment element 102 is in the relaxed state. As shown, the lattice structure 118 within the adjustment element 102 is expanded such that the reliefs 120 of the lattice structure 118 have a first width $W_{120}$. To move the adjustment element 102 to the constricted state, pressure within the interior void 106 of the adjustment element 102 is reduced until a vacuum force overcomes the opposing biasing force imparted by the resilient material of the compressible component 108 and collapses the lattice structure 118 at the reliefs 120, transitioning the reliefs 120 from the expanded width $W_{120}$ to a collapsed width $W_{120}$. The reliefs 120 of the compressible component 108 may include various structures including, but not limited to, diamond, wave, egg crate, and/or radial configuration, as described in more detail below. For instance, reliefs 120 may be rectangular or parallelogram-shaped reliefs 120 including a length $L_{120}$ extending across a first pair of opposing corners and a width $W_{120}$ extending across a second pair of opposing corners that are arranged transverse (e.g., perpendicular) to the length $L_{120}$. In the illustrated example, the width $W_{120}$ of each relief 120 is less than the length $L_{120}$ such that the reliefs 120 are configured to collapse along the widthwise direction when the pressure is reduced within the chamber 116 (FIG. 4B). Accordingly, orientations of the reliefs 120 may be selected depending on a desired transition profile between the expanded state and the constricted state. For example, the aspect ratio may be approximately 10 millimeters by approximately 15 millimeters. Alternatively, the aspect ratio of the reliefs 120 may be greater than approximately 10 millimeters by approximately 15 millimeters or may be less than approximately 10 millimeters by approximately 15 millimeters. The aspect ratio of the reliefs 120 may be generally dependent on the configuration, dimensions, and general shape of the reliefs 120, such that a range of aspect ratios is contemplated for the reliefs 120. Each of the reliefs 120 may be vertically aligned to form the compressible component 108, as illustrated in FIG. 1A.

In one example, the reliefs 120 may have a generally diamond shape, as mentioned above. The diamond shape of the reliefs 120 may be any configuration, such that the reliefs may be narrow, large, small, wide, thin, square, rectangular, and/or any diamond shape. It is contemplated that the reliefs 120 may shrink along the x-axis and elongate along the y-axis during translation from the relaxed state to the constricted state. The percent shrinkage of the reliefs 120 along the x-axis may be between approximately 0.05 percent and approximately 62 percent, depending on the configuration of the reliefs 120. For example, the x-axis dimensions of the reliefs 120 may shrink as the vacuum pressure within the bladder 104 (FIG. 4A) is increased. In one example, the x-axis dimensions of the reliefs 120 may shrink from approximately 160 millimeters to approximately 60 millimeters as the vacuum pressure is increased from 0 inches of mercury (inHg) to approximately 20 inHg. It is also contemplated that the percent elongation of the reliefs 120 along the y-axis may be between approximately 0.5 percent and approximately 15 percent.

Referring now to FIGS. 2, 5A, and 5B, the reliefs 120*a* of the compressible component 108*a* may be formed as polygonal-shaped or circle-shaped apertures extending through the thickness Tioga (FIG. 5A) of the compressible component 108*a*. As mentioned above, the compressible component 108*a* includes the lattice structure 118*a* including the plurality of reliefs 120*a*. For instance, reliefs $\mathbf{120}a_1$ may be rectangular, diamond, parallelogram, or polygonal-shaped reliefs $\mathbf{120}a_1$ including a length $L_{120a1}$ extending across a first pair of opposing corners and a width $W_{120a1}$ extending across a second pair of opposing corners that are arranged transverse (e.g., perpendicular) to the length $L_{120a1}$. In the illustrated example, the width $W_{120a1}$ of each relief $\mathbf{120}a_1$ is less than the length $L_{120a1}$ such that the reliefs $\mathbf{120}a_1$ are configured to collapse along the widthwise direction when the pressure is reduced within the chamber 116. Accordingly, orientations of the reliefs $\mathbf{120}a_1$ may be selected depending on a desired transition between the expanded state and the constricted state.

The reliefs 120*a* may further include circular or generally circle-shaped reliefs $\mathbf{120}a_2$ having a diameter $D_{120a2}$. In the illustrated example, the circle-shaped reliefs $\mathbf{120}a_2$ are not configured to collapse when the pressure is reduced within the chamber 116 (FIG. 5B). The circle-shaped reliefs $\mathbf{120}a_2$ may remain passive under the vacuum, compared to the contraction of the polygonal-shaped reliefs $\mathbf{120}a_1$. It is contemplated that a combination of the circle-shaped reliefs $\mathbf{120}a_2$ and the polygonal-shaped reliefs $\mathbf{120}a_1$ may be positioned to generally correspond to the transition region 56 (FIG. 2) of the bra $\mathbf{10}a_1$, described in more detail below. Stated differently, the combination of the circle-shaped and polygonal-shaped reliefs $\mathbf{120}a_2$, $\mathbf{120}a_1$ may result in a lesser degree of contraction as compared to the polygonal-shaped reliefs $\mathbf{120}a_1$ alone and a greater degree of contraction as compared to the circle-shaped reliefs $\mathbf{120}a_2$ alone. While the circle-shaped reliefs $\mathbf{120}a_2$ are generally passive, it is contemplated that the circle-shaped reliefs $\mathbf{120}a_2$ may compress minimally to draw together any potential connecting portions of the lattice structure 118*a* between the circle-shaped reliefs $\mathbf{120}a_2$. Accordingly, orientations of the reliefs $\mathbf{120}a_2$ may be selected depending on a desired location for maintaining the relaxed state or expanded state.

The compressible components 108-108*b* include one or more resilient materials configured to bias the adjustment element 102 towards the expanded or relaxed state. For example, the compressible components 108-108*b* may include an elastomeric material, such as the EVA foam. In one example, the EVA foam may have a thickness of approximately 6 millimeters. Alternatively, the thickness of the EVA foam may be greater than or less than approximately 2 millimeters to approximately 10 millimeters. In other examples, the compressible components 108-108*b* may include unfoamed polymers, such as thermoplastic polyurethane. Optionally, the compressible component may include fiber-reinforced elastomeric materials. In some implementations, the compressible components 108-108*b* may be formed from 3D printing. In addition to including different materials, the lattice structure 118 may include different geometrical configurations to impart different constriction profiles in different areas of the adjustment element 102. Optionally, a thickness of the compressible components 108-108*b* ranges from 4 millimeters to 8 millimeters to provide the adjustment element 102 with a relatively low profile while also providing sufficient structural strength for biasing the adjustment element 102 to the expanded or relaxed state.

Figure 7:
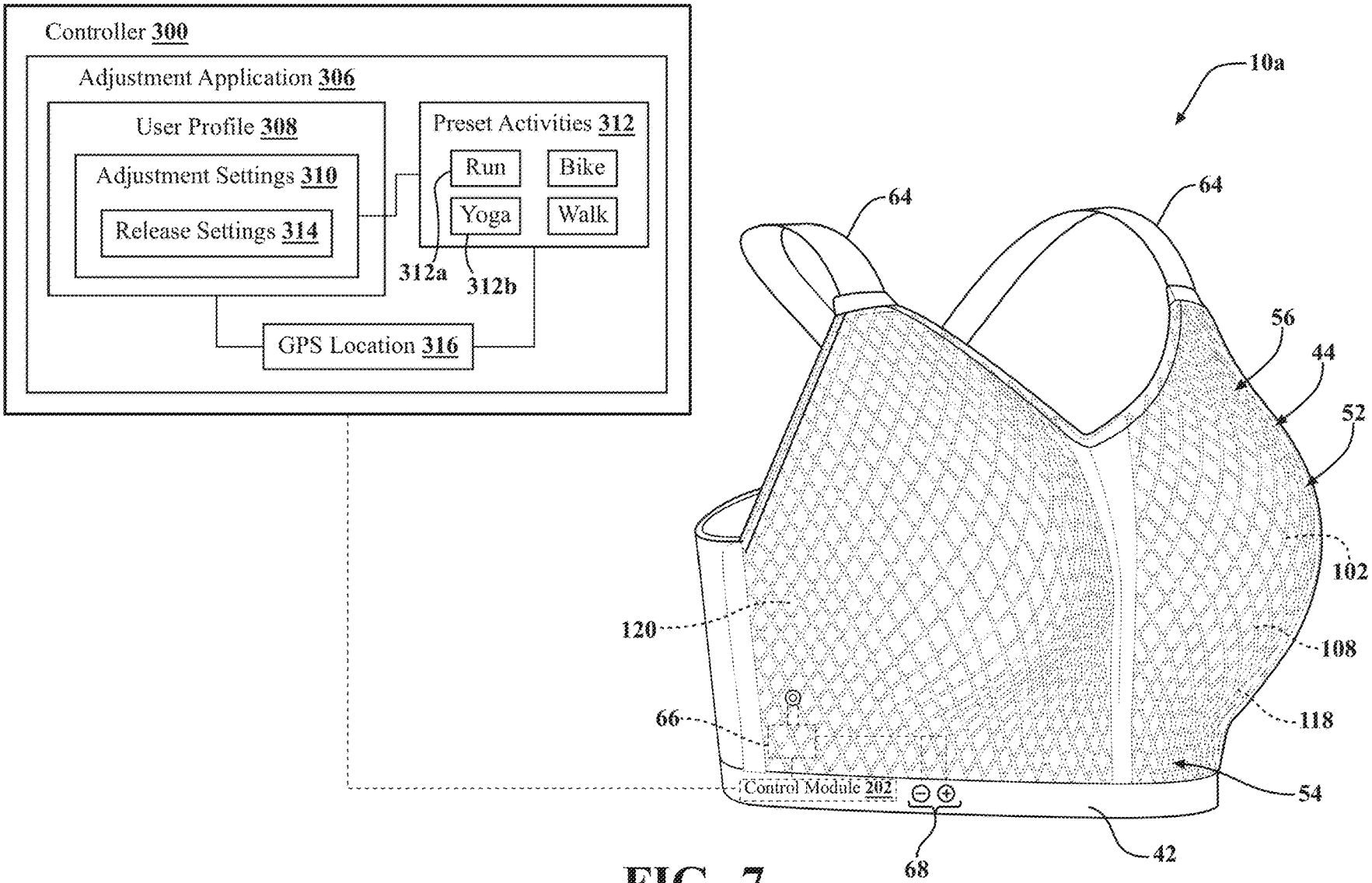
FIG. 7 is a schematic of an article of apparel of the present disclosure in communication with a controller and an adjustment application.
Figure 8A:
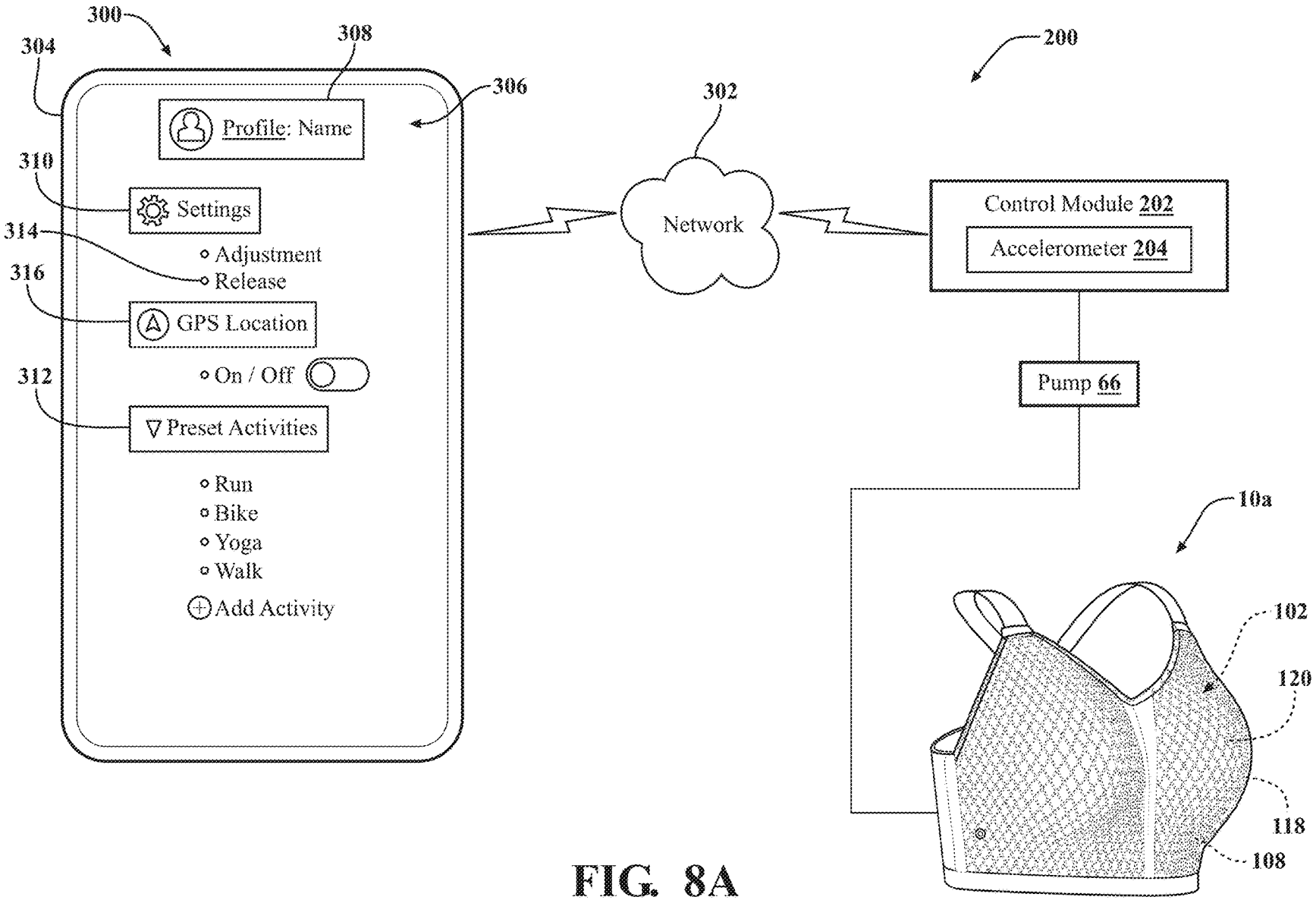
FIG. 8A is a schematic of the article of apparel of FIG. 6 with a control module configured with an accelerometer, the control module in communication with the adjustment application of the controller.
Figure 8B:
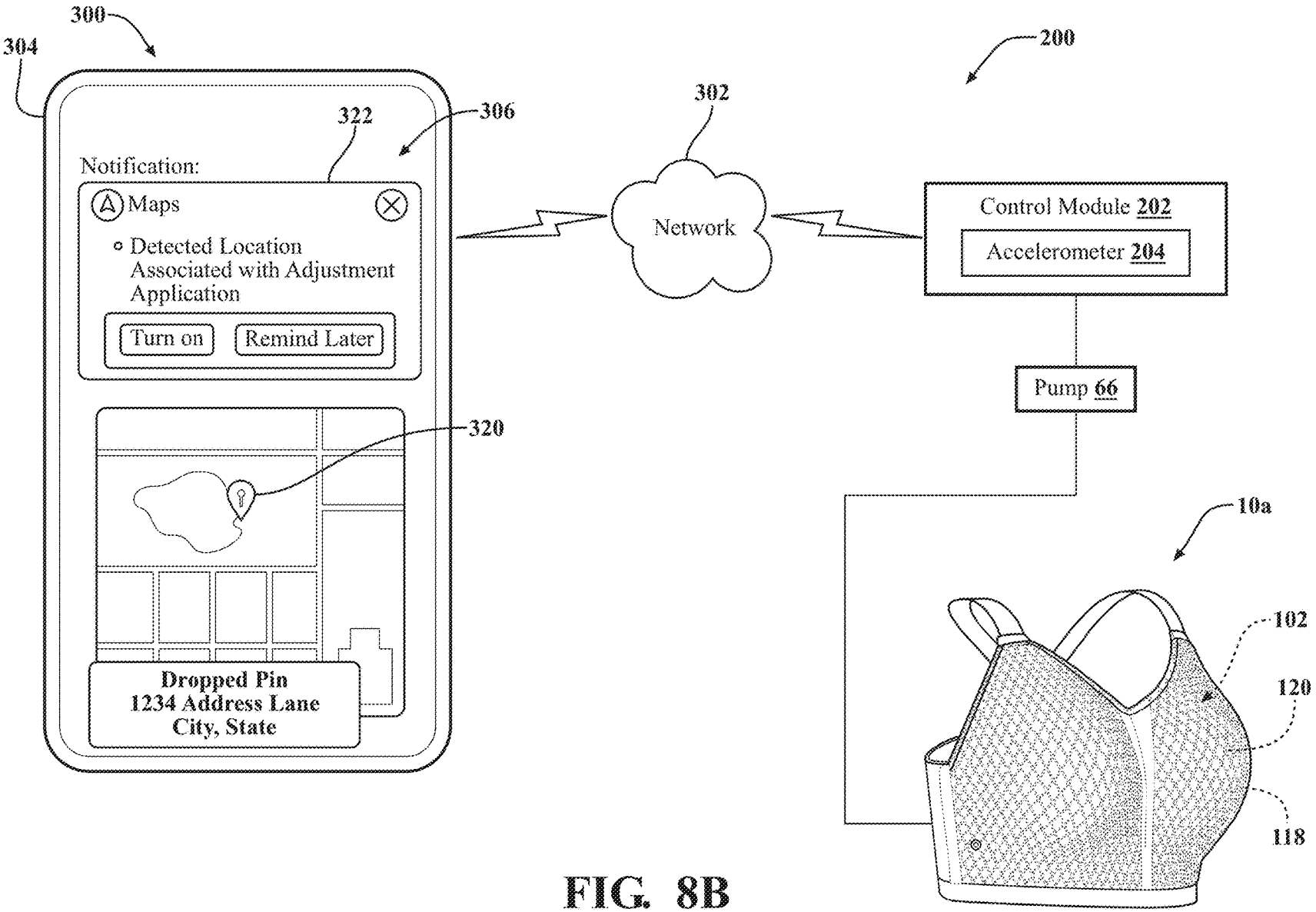
FIG. 8B is a schematic of the article of apparel of FIG. 7 with the adjustment application in communication with the control module, where the control module is responsive to a GPS location detected by the adjustment application.

Referring now to FIGS. 7-8B, the adjustment system 200 includes a control module 202 integrated with the bra 10*a* and operably coupled to the adjustment element 102 via the pump 66. The control module 202 is configured to translate the adjustment element 102 of the bra 10*a* between the relaxed and constricted states via the pump 66 based on geographical location, activity type, and/or one or more condition-responsive parameters such as, for example, motion, humidity, and/or temperature.

As described in more detail below, the control module 202 may detect environmental changes with respect to the bra 10*a* and adjust the adjustment element 102 in response to the detected environmental changes. It is also contemplated that the control module 202 may be communicatively coupled with a controller 300, which may be exterior to the bra 10*a*, via a wireless network 302 to control or otherwise adjust the internal pressure of the bra 10*a*. The control module 202 may be configured with an alternate wireless communication system, such as Bluetooth®, to communicate with the controller 300. For example, the controller 300 may be a computer or other remote computer system operable to communicate with the control module 202 of the bra 10*a*. By way of example, not limitation, the controller 300 is described herein as a user device 304 including an adjustment application 306. The user device 304 may include, but it is not limited to, a mobile device, a watch, a computer, and/or a tablet. The control module 202 may be communicatively coupled to the adjustment application 306 of the user device 304, such that the adjustment application 306 may be utilized to monitor, modify, and generally communicate functions with the control module 202. The wearer may utilize the adjustment application 306 to adjust the fit of the bra 10*a* via communication between the controller 300 and the control module 202 of the bra 10*a*.

The adjustment application 306 may include a user profile 308 in which the wearer may upload information associated with the wearer, such as biometric data (i.e., height, weight, bust measurements, shoe size, etc.). The user profile 308 may also include adjustment settings 310 that may correspond with the degree of compression of the adjustment element 102 based on various activities. For example, the wearer may modify the adjustment settings 310 to have a minimum and/or maximum degree of compression via adjustment of an interior pressure value associated with the adjustment element 102. It is contemplated that the wearer may modify the adjustment settings 310 for a plurality of preset activities 312 (i.e., running, biking, yoga, etc.) to customize the fit of the bra 10*a* during each respective activity 312. For example, the adjustment setting 310 may be set to adjust the bra 10*a* to have a high degree of compression when the preset activity 312 is associated with a high-impact activity 312*a* (e.g., running) and the adjustment setting 310 may be set to adjust the bra 10*a* to have a low degree of compression when the preset activity 312 is associated with a low-impact activity 312*b* (e.g., yoga). The adjustment settings 310 may also include a release setting 314 corresponding to the bra 10*a* releasing all vacuum within the chamber 116 to define the relaxed state. As described herein, the adjustment element 102 may have a variable degree of compression, such that the constricted state is defined across a range of degrees of vacuum, and the relaxed state is defined by the complete release of the vacuum within the chamber 116. Additionally or alternatively, the preset activities 312 may be directly associated with the adjustment settings 310, such that the wearer may set the desired degree of compression associated with each activity 312. The wearer may modify the preset activities 312 by adding and/or removing activities 312. The wearer may also periodically adjust the associated pressure with each activity based on experience to customize the fit of the bra 10*a*.

With further reference to FIGS. 7-8B, the adjustment application 306 may utilize a Global Positioning System (GPS) location 316 of the user device 304 to detect patterns and regularly visited locations of the wearer. The adjustment application 306 may detect that the user regularly visits a location associated with a gym, a track, a yoga studio, and/or other areas that may be associated with a workout routine of the user. In one example, the user may manually update the user profile 308 to include locations where the user may typically begin one of the preset activities 312, such as the start of a running route, by dropping a pin 320 associated with the GPS location 316 of the associated exercise. The adjustment application 306 may prompt the wearer to activate the pump 66 of the bra 10*a* when arriving at the GPS location 316 associated with one of the preset activities 312. In response to the detected GPS location 316, the adjustment application 306 may prompt a notification 322 on the user device 304 to adjust the adjustment element 102 to the compression degree associated with the activity 312 based on the detected location. The notification 322 may be prompted by the controller 300 after the GPS location 316 is detected for a predetermined period of time. For example, the notification 322 is triggered by the adjustment application 306 after the controller 300 determines the wearer is located at the GPS location 316 for the predetermined period of time. The predetermined period of time may range between approximately one (1) minute and 15 minutes. The predetermined period of time may also be approximately less than or equal to one (1) minute or approximately greater than or equal to 15 minutes. The predetermined period of time may account for activities that may utilize less compression (e.g., a pre-workout warm-up). For example, some of the preset activities 312 may include a warm-up setting, which may have a lower compression setting as compared to the activity 312. Additionally or alternatively, the compression setting may be the same for the activity and any associated warm-up.

The user may access the adjustment settings 310 by selecting the notification 322 to modify the degree of compression. As described in more detail below, the degree of compression may be selected and modified based on the degree of impact associated with the activity 312. The wearer may authorize the notification 322 in order to execute compression of the adjustment element 102, and, responsive to authorization of the notification 322, the adjustment application 306 may communicate with the control module 202 to adjust the compression of the adjustment element 102 to the predefined compression associated with the respective activity 312. As mentioned above, the wearer may adjust the compression of the adjustment element 102 at any time via the adjustment application 306, such that the operability of the control module 202 is freely accessible regardless of the GPS location 316 or preset activity 312.

Referring still to FIGS. 7-8B, the control module 202 may also include an accelerometer 204 that can detect movement of the wearer. The accelerometer 204 may detect both horizontal and vertical movement of the wearer and may communicate the detected information with the control module 202. While it is contemplated that the control module 202 may independently adjust the adjustment element 102 in response to data collected by the accelerometer 204, the control module 202 may also communicate the data with the controller 300 to be displayed on the user device 304. The control module 202 may continuously monitor the data from the accelerometer 204 to make adjustments to the vacuum within the chamber 116 of the adjustment element 102 based on the received data. The control module 202 may compare the data collected from the accelerometer 204 with the GPS location 316 detected by the controller 300 to further assess whether the wearer is participating in an activity in which compression of the adjustment element 102 may be advantageous. For example, the user may initiate a run and, in response the adjustment application 306, may prompt the notification 322 recommending compression adjustment based on the GPS location 316. The accelerometer 204 may detect a condition-responsive parameter such as movement of the wearer corresponding to a running motion, and the control module 202 may communicate with the controller 300 to confirm the GPS location 316 with the data from the accelerometer 204. If the GPS location 316 corresponds with a location associated with one of the preset activities 312, then the control module 202 may activate the pump 66 to translate the adjustment element 102 from the relaxed state to the constricted state. The controller 300 may also detect a frequently visited location based on the GPS location 316 that may be unassigned to one of the preset activities 312. The controller 300 may prompt the notification 322 to include an option for the wearer to drop a new pin 320 and/or associate the detected location 316 with one of the activities 312.

Figure 9:
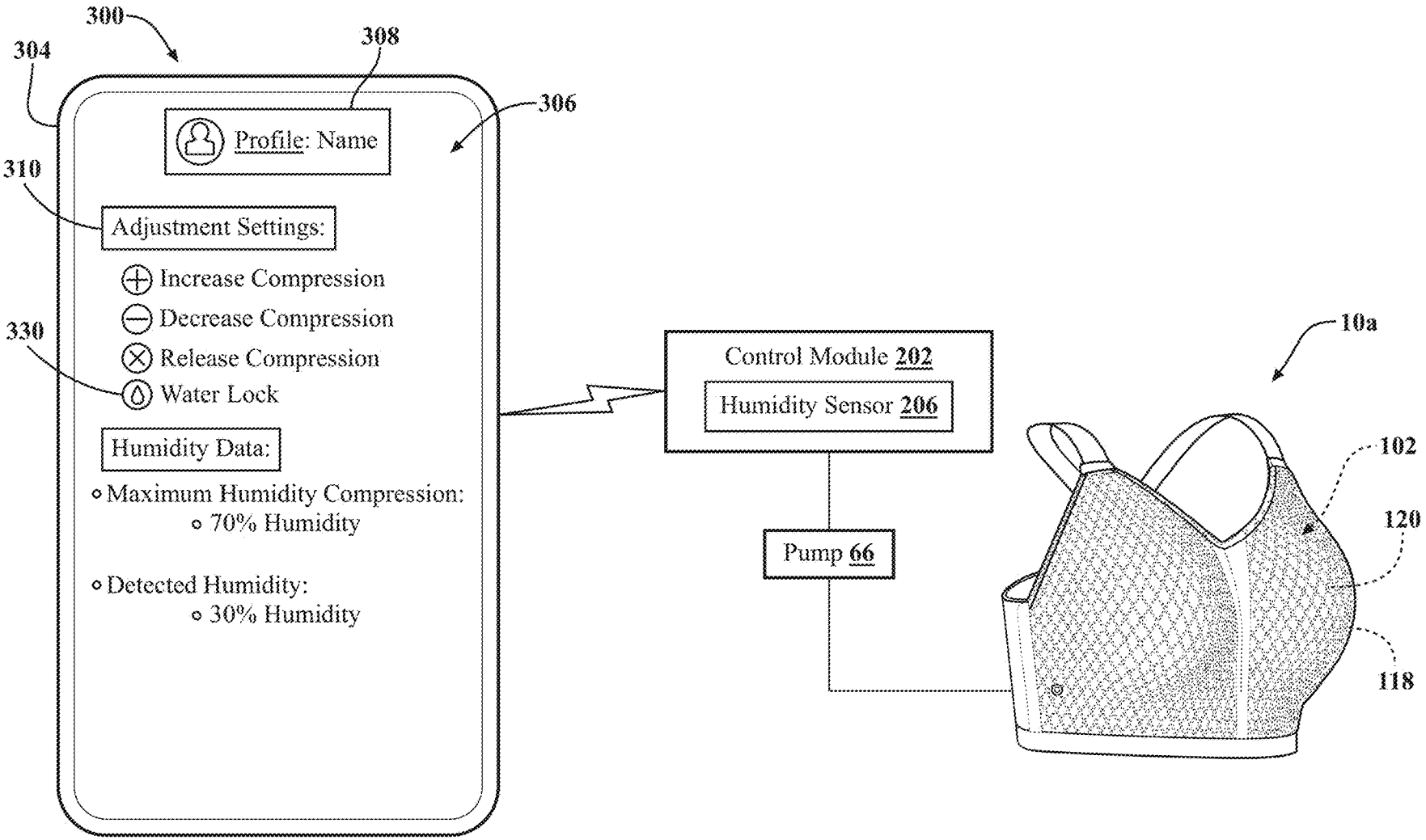
FIG. 9 is a schematic of an article of apparel of the present disclosure with a control module configured with a humidity sensor, the control module in communication with an adjustment application of a controller.

With reference to FIG. 9, the control module 202 may also include a humidity and/or temperature sensor 206 configured to detect the relative humidity and/or temperature of the skin of the wearer proximate to the bra 10*a*. The control module 202 may utilize the detected humidity and/or temperature data to adjust the compression of the bra 10*a*. For example, an increased degree of detected humidity may indicate an increased intensity of the activity 312, such that an increase in compression may be desired. The control module 202 may increase the compression of the adjustment element 102 as the detected humidity increases. Alternatively, the control module 202 may reduce the compression of the adjustment element 102 in response to the detected humidity increase in an effort to permit air to flow between the skin of the wearer and the bra 10*a*, thereby cooling the wearer.

The control module 202 may be configured with a maximum degree of compression, which may be set during configuration of the control module 202. Additionally or alternatively, the wearer may set the maximum degree of compression in the adjustment settings 310 of the adjustment application 306. The wearer may also manually adjust the compression of the adjustment element 102 via the actuators 68 (FIG. 1A) to increase or decrease compression in response to the automatically adjusted compression executed by the control module 202. When there is a manual adjustment, the control module 202 may communicate the manually set compression with the controller 300, and the controller 300 may store the manually set compression in the adjustment settings 310 of the user profile 308 and may associate the manually set compression with the activity 312 during which the manual adjustment was made.

The controller 300 may communicate a degree of compression with the control module 202 based on the detected humidity and/or the activity 312. For example, as the detected humidity increases, the controller 300 may determine the wearer is engaging in a high-impact activity 312*a* (e.g., running) and may communicate with the control module 202 to increase the compression of the adjustment element 102. It is also contemplated that the control module 202 may detect the increased humidity and may detect the increased humidity resulting in an increase in compression. Where the wearer is utilizing the bra 10*a* in a water activity, the adjustment application 306 may include a lock function 330 that prevents water from entering the control module 202. The lock function may also be utilized to prevent adjustment based on the humidity sensor 206. The wearer, when using the bra 10*a* in water, may set the desired compression via the adjustment application 306 and/or the actuators 68, such that any additional adjustment after executing the lock function 330 is a result of the manual adjustment by the wearer.

Referring now to FIG. 10, the footwear 70 includes the control module 202, which may be positioned in the sole structure 74 of the footwear 70. As described above, the control module 202 may include the accelerometer 204 and the humidity sensor 206 and cooperates with the controller 300 to relax and compress the adjustment element 102*b* in the upper 72 of the footwear 70. In addition to the preset activities 312 mentioned above, the adjustment application 306 may be configured with additional preset activities 312 pertaining to adjustment of the footwear 70. For example, the adjustment application 306 may include activities 312 such as basketball 312*e* and/or tennis 312*f* in addition to the activities 312 mentioned above (i.e., high-impact activities 312*a* and low-impact activities 312*b*). Each of the activities 312 may be configured with a set compression, such that the wearer may select the activity 312 on the user device 304. For example, a wearer may define basketball 312*e* and/or tennis 312*f* to be high-impact activities and may set the adjustment element 102*b* to near maximum constriction to provide the wearer with maximum support during cutting and banking movements associated with these activities.

The adjustment application 306 may receive an input from the wearer corresponding to an activity and/or may receive data from the control module 202 with respect to the movement and/or humidity relative to the footwear 70. The adjustment application 306 may communicate via the controller 300 with the control module 202, and the control module 202 may activate the pump 66 to adjust the adjustment element 102*b*. It is also contemplated that the control module 202 may independently adjust the adjustment element 102*b* and communicate the activation of the pump 66 with the controller 300 for display on the user device 304. For example, the adjustment element 102*b* may compress and relax, which also results in the compression and relaxation of the upper 72. The adjustment element 102 may provide additional support and stabilization for the wearer when in the compressed state, which may be advantageous for one or more of the preset activities 312. The wearer may adjust the compressive force of the adjustment element 102*b* via the adjustment application 306 and/or the actuators 68 disposed on the footwear 70. The control module 202 may generally execute the functions described with respect to FIGS. 7-9 to transition the upper 72 between the relaxed state and the compressed state via the adjustment element 102.

Figure 11:
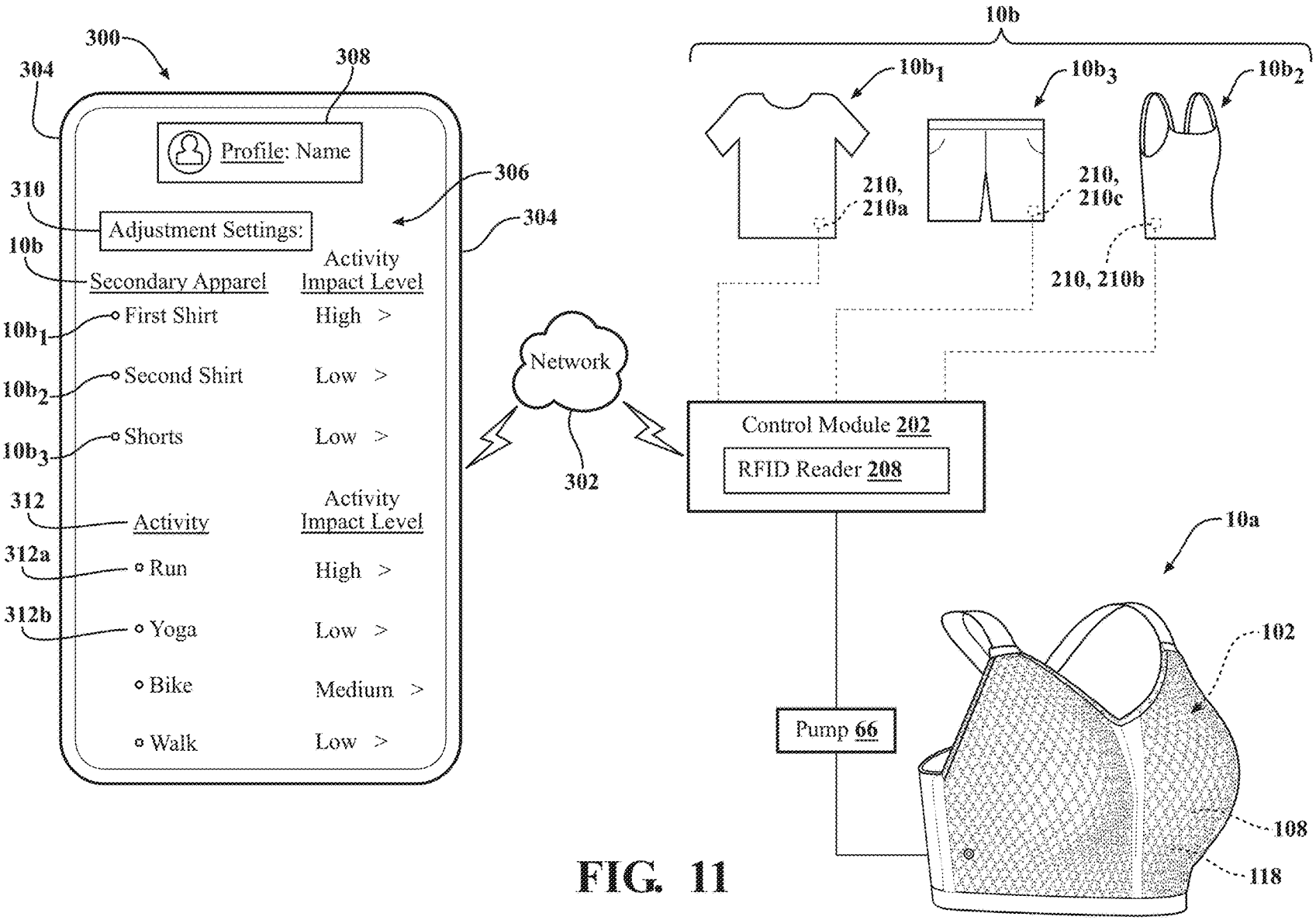
FIG. 11 is a schematic of a bra of the present disclosure with a radio frequency identification (RFID) reader and a secondary article with an RFID tag, where a control module of the bra is responsive to the RFID reader detecting the RFID tag of the secondary article.
Figure 12:
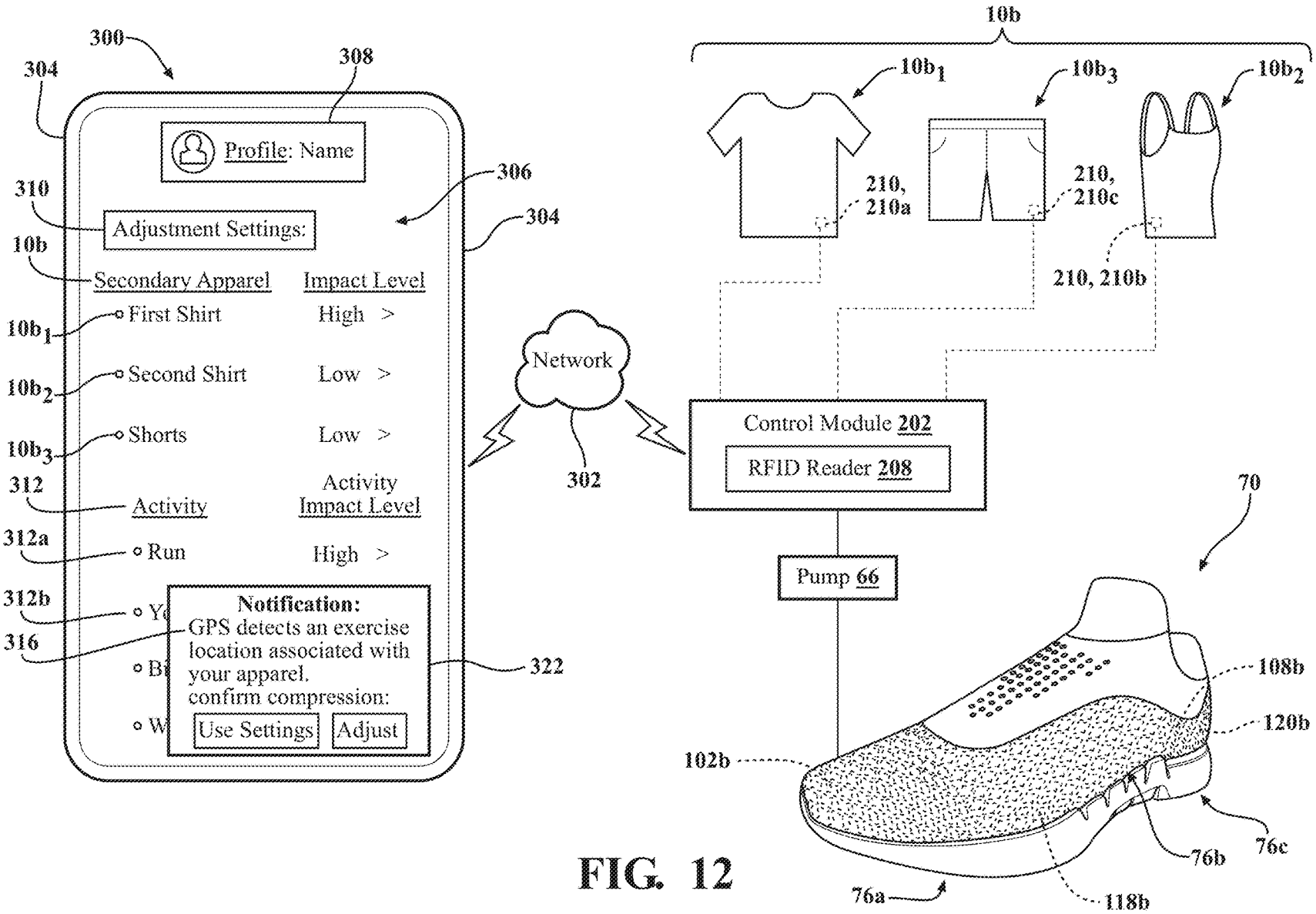
FIG. 12 is a schematic of an article of footwear of the present disclosure with an RFID reader and a secondary article with an RFID tag, where a control module of the footwear is responsive to the RFID reader detecting the RFID tag of the secondary article.

Referring to FIGS. 11 and 12, the control module 202 may be configured with a radiofrequency identification (RFID) reader 208, which is configured to detect RFID tags 210 that may be incorporated with the secondary apparel 10*b*. The RFID tags 210 may be integrally formed with the secondary apparel 10*b* via integration into fabric of the secondary apparel 10*b*. Additionally or alternatively, the RFID tags 210 may be attached to the secondary apparel 10*b* when the secondary apparel 10*b* is utilized in combination with the bra 10*a*. For example, the wearer may attach the RFID tag 210 to the secondary apparel 10*b* when donning the secondary apparel 10*b* and may remove the RFID tag 210 when doffing the secondary apparel 10*b*. In this manner, the wearer may utilize various secondary apparel 10*b* items with a single RFID tag 210.

The RFID reader 208 utilizes electromagnetic fields to detect and identify the RFID tags 210 to determine the degree of compression of the adjustment element 102. In one implementation, the secondary apparel 10*b* may include a first shirt $\mathbf{10}b_1$ that has a first tag 210*a* and a second shirt $\mathbf{10}b_2$ that has a second tag 210*b*. The first tag 210*a* may identify that the first shirt $\mathbf{10}b_1$ is used during a high-impact activity 312*a*, and the second tag 210*b* may identify that the second shirt $\mathbf{10}b_2$ is used during with a low-impact activity 312*b*. By way of example, not limitation, the control module 202 of the adjustment system 200 may detect the first tag 210*a* of the first shirt 10$b_1$ and increase the compression of the adjustment element 102. The compression of the adjustment element 102 may be increased upon detection of the first tag 210*a*, as the first shirt 10$b_1$ may be typically worn during a high-impact activity 312*a*. High-impact activities 312*a* typically benefit from an increase in compression of the bra 10*a* to provide additional stability and support for the wearer. Comparatively, the compression of the adjustment element 102 may be relaxed in part upon detection of the second tag 210*b*, which may be associated with the second shirt 10$b_2$ that may be used during a low-impact activity 312*b*. Low-impact activities 312*b* may utilize a decreased degree of compression as compared to high-impact activities 312*a*. As mentioned above, the wearer may manually adjust the control module 202 to increase or decrease the compression of the bra 10*a* depending on a desired degree of support regardless of the activity 312.

The RFID tags 210 may include information pertaining to the corresponding secondary apparel 10*b*, such that the control module 202 may communicate information detected by the RFID reader 208 to the controller 300. In response to the information identified by the RFID reader 208, the adjustment application 306 of the controller 300 may prompt adjustment options based on the secondary apparel 10*b* detected. If the RFID reader 208 detects multiple RFID tags 210, such that the wearer is combining secondary apparel 10*b*, the controller 300 may utilize additional information gathered, such as GPS location 316, to determine the degree of compression desired. For example, the wearer may utilize a first shirt 10$b_1$ that has an RFID tag 210*a* associated with a high-impact activity 312*a* and a pair of shorts 10$b_3$ that has an RFID tag 210*c* associated with a low-impact activity 312*b*. The controller 300 may utilize the GPS location 316 to determine that the wearer is in a location typically associated with the low-impact activity 312*b* and may prompt with a notification 322 to the wearer to confirm the degree of compression. The wearer may confirm or reject the notification 322 and, as mentioned above, may manually adjust the compression to the desired degree of compression. While the controller 300 is described as prompting a wearer to confirm a degree of compression, the controller 300 could automatically control the degree of compression when predetermined conditions are determined.

The control module 202 incorporated in the footwear 70 may similarly be configured with the RFID reader 208 to detect the RFID tags 210 of the secondary apparel 10*b* that may be utilized in combination with the footwear 70. For example, the RFID reader 208 may detect the RFID tag 210 associated with a high-impact activity 312*a*, which results in the adjustment element 102*b* transitioning from the relaxed state to the compressed state. As similarly described above, the control module 202 may cooperate with the adjustment application 306 of the controller 300 to modify the compression of the adjustment element 102*b* based on the RFID tag 210 detected by the RFID reader 208.

Figure 13:
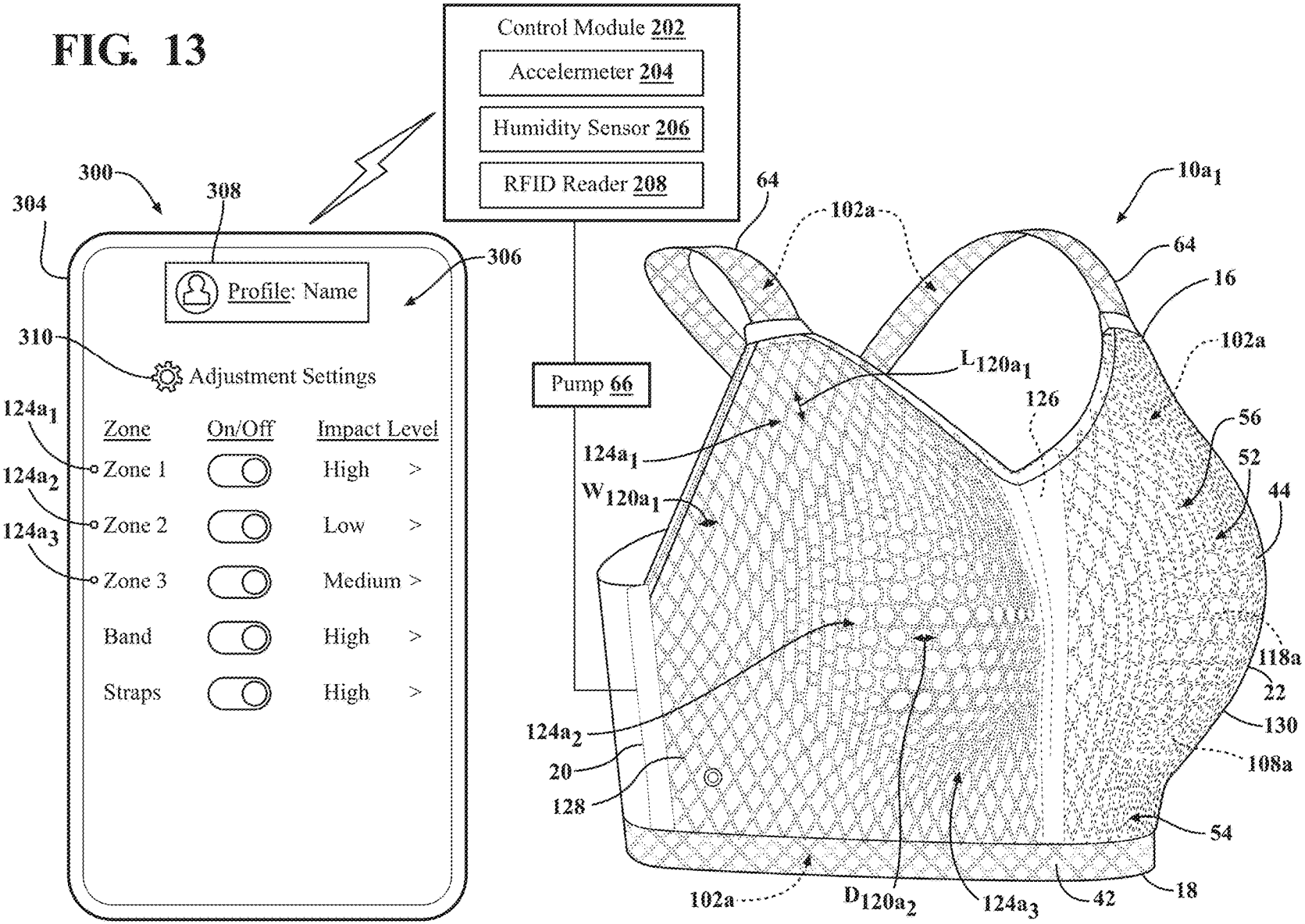
FIG. 13 is a schematic of an article of apparel of the present disclosure with a control module in communication with a controller, where the control module adjusts zones of the article of apparel in response to inputs to the controller.

Referring now to FIGS. 1A and 13, the compressible component 108 may include a single adjustment zone 124, such that the lattice structure 118 may uniformly adjust during application of the vacuum to the compressible component. Additionally or alternatively, the lattice structure 118 may have variable adjustment depending on the fit of the bra 10*a* relative to the wearer. For example, as illustrated in FIG. 13, the adjustment element 102*a* may include a plurality of adjustment zones 124$a_1$-124$a_3$ to impart different transformation characteristics along the bra 10$a_1$. For example, the compressible component 108*a* includes a first adjustment zone 124$a_1$ arranged along the perimeter cup region 54 (FIG. 2) of the front panel 44 and including an array (e.g., rows and columns) of the reliefs 120$a_1$ having the widths $W_{120a1}$ oriented across a transverse direction (i.e., from the right side 20 to the left side 22) of the front panel 44 and the lengths $L_{120a1}$ oriented along the longitudinal direction (i.e., from the upper end 16 to the lower end 18) of the front panel 44. Thus, the reliefs 120$a_1$ of the first adjustment zone 124$a_1$ are configured to selectively constrict the perimeter cup region 54 of the front panel 44 along the widthwise direction over the upper-torso of the wearer. The compressible component 108*a* may further include a central element 126 corresponding to the center bridge 48 (FIG. 2) and generally dividing the compressible component 108*a* into a right side 128 and a left side 130 corresponding to the right panel 46 and the left panel 50 of the front panel 44.

With continued reference to FIG. 13, the central portions of the compressible component 108*a* form a second adjustment zone 124$a_2$ arranged in the central cup region 52 of the right panel 46 and the left panel 50 of the front panel 44. The second adjustment zone 124$a_2$ includes an array of the reliefs 120$a_2$ with diameters $D_{120a2}$. The second adjustment zone 124$a_2$ is configured to create a static or passive region within the bra 10*a* where the compressible component 108*a* and the front panel 44 do not contract or contract to a lesser extent than the first adjustment zone 124$a_1$. Accordingly, the central cup region 52 maintains substantially the same shape whether the compressible component 108*a* is in the relaxed state or the contracted state. The compressible component 108*a* includes a third adjustment zone 124$a_3$ formed in the transition region 56 between the perimeter cup region 54 and the central cup region 52. Here, the reliefs 120*a* include a combination of the reliefs 120$a_1$ and 120$a_2$ oriented in an alternating arrangement. Accordingly, the third adjustment zone 124$a_3$ is configured to constrict the transition region 56 less than the perimeter cup region 54, but more than the central cup region 52 as the adjustment element 102*a* (FIG. 5A) is moved from the relaxed state to the constricted state.

The control module 202 may be configured to selectively adjust the adjustment element 102*a* at the adjustment zones 124$a_1$-124$a_3$, such that each adjustment zone 124$a_1$-124$a_3$ may be independently adjusted based on the preset activity 312 either detected or communicated. For example, the control module 202 may utilize any one of the accelerometer 204, the humidity sensor 206, and/or the RFID reader 208 to determine the degree of compression required or desired and selectively adjust one or more of the adjustment zones 124$a_1$-124$a_3$ in response. The adjustment application 306 may also include the adjustment zones 124$a_1$-124$a_3$ as part of the adjustment settings 310. In this implementation, the wearer may select the adjustment zone 124$a_1$-124$a_3$ and set the degree of compression (e.g., high, medium, low) for each respective adjustment zone 124$a_1$-124$a_3$. It is also contemplated that the band 42 and the straps 64 may be incorporated with the adjustment element 102*a*, such that the wearer may independently adjust the band 42 and straps 64 of the bra 10$a_1$.

Figure 14:
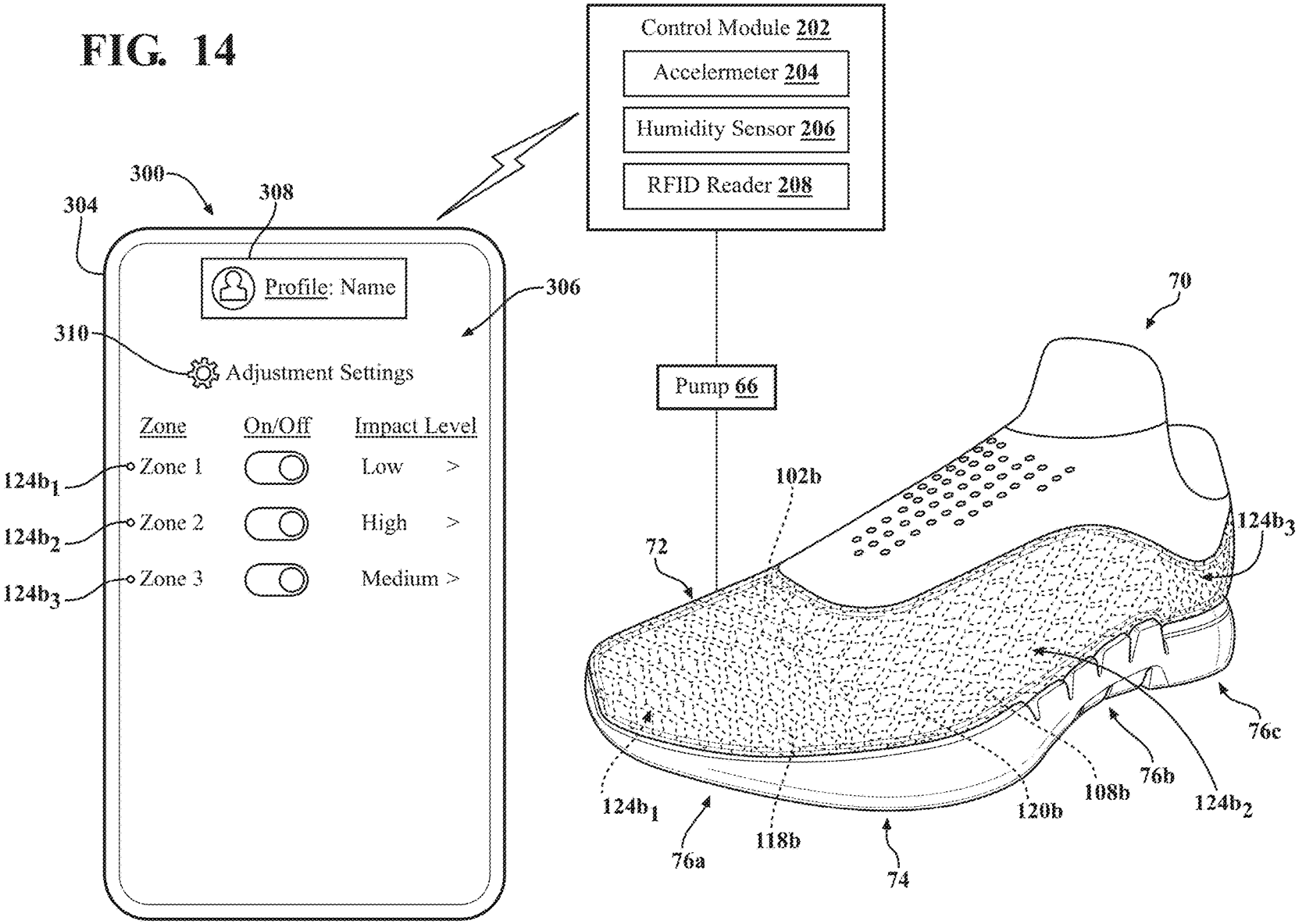
FIG. 14 is a schematic of an article of footwear according to the present disclosure with a control module in communication with a controller, where the control module adjusts zones of the article of footwear in response to inputs to the controller.

With reference to FIG. 14, the footwear 70 may include adjustment zones 124$b_1$-124$b_3$ associated with the forefoot region 76*a*, the mid-foot region 76*b*, and the heel region 76*c* of the footwear 70. For example, the control module 202 may selectively adjust each of the adjustment zones 124$b_1$-124$b_3$ to adjust individual regions 76*a*-76*c* of the footwear 70. It may be advantageous for the footwear 70 to have the adjustment element 102*b* compressed at some adjustment zones 124$b_1$-124$b_3$ as compared to others depending on the activity 312. It is also contemplated that the adjustment zones 124$b_1$-124$b_3$ may be utilized for anatomical support for the wearer. For example, the wearer may input in the user profile 308 of the adjustment application 306 biometric data associated with flat feet. The adjustment application 306 may communicate with the control module 202 to increase compression along the mid-foot region 76*b* to provide additional support for the mid-foot of the wearer. In some implementations, the preset activity 312 selected by the wearer or determined by the control module 202 may benefit from the selective compression of the various regions 76*a*-76*c* of the upper 72 via the adjustment element 102*b*. The adjustment application 306 may provide the option for the wearer to activate the adjustment zones 124$b_1$-124$b_3$ and set the degree of compression (e.g., high, medium, low). Each adjustment zone 124$b_1$-124$b_3$ may be independently activated and, if activated, independently compressed or relaxed.

Referring again to FIGS. 1-14, the bras 10*a*, 10$a_1$ and the footwear 70 may provide compressive support by utilizing the adjustment elements 102-102*b*. The arrangement of the reliefs 120-120*b* of the compressible components 108-108*b* may advantageously include the adjustment zone(s) 124-124$b_3$ to provide customized support and/or compression for the wearer. For example, the reliefs 120-120*b* may be arranged in a radial configuration and/or an array configuration. The bras 10*a*, 10$a_1$ and the footwear 70 also include the adjustment system 200 to adjust the compression of the respective adjustment element 102-102*b* to provide a customized fit for the wearer during an activity 312. The wearer may utilize the adjustment application 306 to adjust the articles 10*a*, 10$a_1$, 70 during use, and the adjustment application 306 may communicate with the control module 202 to gather data utilized in determining the degree of compression of the respective adjustment element 102-102*b*.

Figure 15:
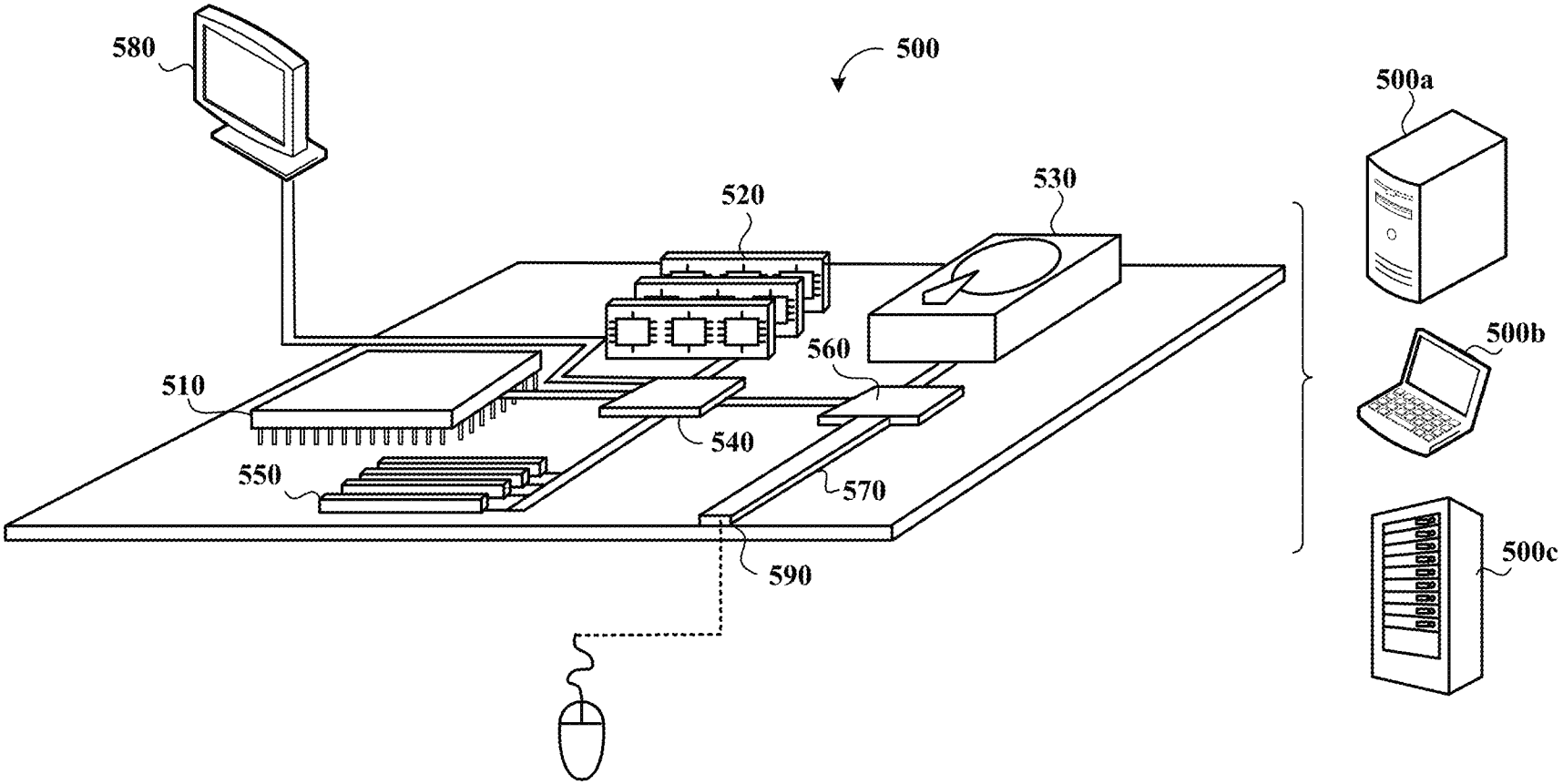
FIG. 15 is a schematic view of an example computing device that may be used to implement the systems and methods described herein.

FIG. 15 is a schematic view of an example computing device 500 that may be used to implement the systems and methods described in this document. The computing device 500 is intended to represent various forms of digital computers, such as laptops, desktops, workstations, personal digital assistants, servers, blade servers, mainframes, and other appropriate computers. The components shown here, their connections and relationships, and their functions, are meant to be exemplary only, and are not meant to limit implementations of the inventions described and/or claimed in this document.

The computing device 500 includes a processor 510, memory 520, a storage device 530, a high-speed interface/controller 540 connecting to the memory 520 and high-speed expansion ports 550, and a low speed interface/controller 560 connecting to a low speed bus 570 and a storage device 530. Each of the components 510, 520, 530, 540, 550, and 560, are interconnected using various busses, and may be mounted on a common motherboard or in other manners as appropriate. The processor 510 can process instructions for execution within the computing device 500, including instructions stored in the memory 520 or on the storage device 530 to display graphical information for a graphical user interface (GUI) on an external input/output device, such as display 580 coupled to high speed interface 540. In other implementations, multiple processors and/or multiple buses may be used, as appropriate, along with multiple memories and types of memory. Also, multiple computing devices 500 may be connected, with each device providing portions of the necessary operations (e.g., as a server bank, a group of blade servers, or a multi-processor system).

The memory 520 stores information non-transitorily within the computing device 500. The memory 520 may be a computer-readable medium, a volatile memory unit(s), or non-volatile memory unit(s). The non-transitory memory 520 may be physical devices used to store programs (e.g., sequences of instructions) or data (e.g., program state information) on a temporary or permanent basis for use by the computing device 500. Examples of non-volatile memory include, but are not limited to, flash memory and read-only memory (ROM)/programmable read-only memory (PROM)/erasable programmable read-only memory (EPROM)/electronically erasable programmable read-only memory (EEPROM) (e.g., typically used for firmware, such as boot programs). Examples of volatile memory include, but are not limited to, random access memory (RAM), dynamic random access memory (DRAM), static random access memory (SRAM), phase change memory (PCM) as well as disks or tapes.

The storage device 530 is capable of providing mass storage for the computing device 500. In some implementations, the storage device 530 is a computer-readable medium. In various different implementations, the storage device 530 may be a floppy disk device, a hard disk device, an optical disk device, or a tape device, a flash memory or other similar solid state memory device, or an array of devices, including devices in a storage area network or other configurations. In additional implementations, a computer program product is tangibly embodied in an information carrier. The computer program product contains instructions that, when executed, perform one or more methods, such as those described above. The information carrier is a computer- or machine-readable medium, such as the memory 520, the storage device 530, or memory on processor 510.

The high speed controller 540 manages bandwidth-intensive operations for the computing device 500, while the low speed controller 560 manages lower bandwidth-intensive operations. Such allocation of duties is exemplary only. In some implementations, the high-speed controller 540 is coupled to the memory 520, the display 580 (e.g., through a graphics processor or accelerator), and to the high-speed expansion ports 550, which may accept various expansion cards (not shown). In some implementations, the low-speed controller 560 is coupled to the storage device 530 and a low-speed expansion port 590. The low-speed expansion port 590, which may include various communication ports (e.g., USB, Bluetooth, Ethernet, wireless Ethernet), may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 500*a* or multiple times in a group of such servers 500*a*, as a laptop computer 500*b*, or as part of a rack server system 500*c*.

Various implementations of the systems and techniques described herein can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

The processes and logic flows described in this specification can be performed by one or more programmable processors, also referred to as data processing hardware, executing one or more computer programs to perform functions by operating on input data and generating output. The processes and logic flows can also be performed by special purpose logic circuitry, e.g., an FPGA (field programmable gate array) or an ASIC (application specific integrated circuit). Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

The following Clauses provide an exemplary configuration for an adjustment system for an article of apparel or footwear described above.

Clause 1. An adjustment system for a wearable article includes an adjustment element operable to form at least a portion of the wearable article and including a bladder including an interior void and a compressible component disposed within the interior void, and a control module operably coupled to the adjustment element and configured to translate the compressible component between a relaxed state and a constricted state by controlling a volume of fluid within the interior void in response to a condition-responsive parameter.

Clause 2. The adjustment system of Clause 1, wherein the condition-responsive parameter includes motion, humidity, and/or temperature.

Clause 3. The adjustment system of Clause 2, wherein the control module is operable to translate the compressible component between the relaxed state and the constricted state in response to a geographical location of the control module and/or a type of activity.

Clause 4. The adjustment system of Clause 3, wherein the geographical location is input by a wearer.

Clause 5. The adjustment system of Clause 3, wherein the geographical location is determined using GPS.

Clause 6. The adjustment system of any of the preceding Clauses, wherein the control module is operable to translate the compressible component between the relaxed state and the constricted state in response to a geographical location of the control module and/or a type of activity.

Clause 7. The adjustment system of any of the preceding Clauses, further including at least one of a humidity sensor, a temperature sensor, and an accelerometer in communication with the control module, the at least one of the humidity sensor, the temperature sensor, and the accelerometer operable to provide the control module with the condition-responsive parameter.

Clause 8. The adjustment system of any of the preceding Clauses, further including an RFID reader associated with the control module, the control module operable to translate the compressible component between the relaxed state and the constricted state based on data received by the RFID reader.

Clause 9. The adjustment system of Clause 8, further including an RFID tag associated with an article of apparel or an article of footwear, the RFID tag in communication with the RFID reader and operable to provide the data to the RFID reader.

Clause 10. The adjustment system of any of the preceding Clauses, further including a controller in communication with the control module and operable to display a status of the compressible component.

Clause 11. An adjustment system for a wearable article including an adjustment element operable to form at least portion of the wearable article and including a bladder including an interior void and a compressible component disposed within the interior void and a control module operably coupled to the adjustment element and configured to translate the compressible component between a relaxed state and a constricted state by controlling a volume of fluid within the interior void in response to at least one of geographical location, activity type, and type of secondary wearable article used in conjunction with the wearable article.

Clause 12. The adjustment system of Clause 11, wherein the control module is operable to translate the compressible component between the relaxed state and the constricted state in response to a condition-responsive parameter.

Clause 13. The adjustment system of Clause 12, wherein the condition-responsive parameter includes motion, humidity, and/or temperature.

Clause 14. The adjustment system of any of the preceding Clauses, wherein the geographical location is input by a wearer.

Clause 15. The adjustment system of any of the preceding Clauses, wherein the geographical location is determined using GPS.

Clause 16. The adjustment system of any of the preceding Clauses, further including at least one of a humidity sensor, a temperature sensor, and an accelerometer in communication with the control module, the at least one of the humidity sensor, the temperature sensor, and the accelerometer operable to provide the control module with a condition-responsive parameter.

Clause 17. The adjustment system of Clause 16, wherein the control module is operable to translate the compressible component between the relaxed state and the constricted state in response to the condition-responsive parameter.

Clause 18. The adjustment system of any of the preceding Clauses, further including an RFID reader associated with the control module, the control module operable to translate the compressible component between the relaxed state and the constricted state based on data received by the RFID reader.

Clause 19. The adjustment system of Clause 18, further including an RFID tag associated with the secondary wearable article, the RFID tag in communication with the RFID reader and operable to provide the data to the RFID reader.

Clause 20. The adjustment system of any of the preceding Clauses, further including a controller in communication with the control module and operable to display a status of the compressible component.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An adjustment system for a wearable article, the adjustment system comprising:

an adjustment element operable to form at least a portion of the wearable article and including (i) a bladder including an interior void and (ii) a compressible component disposed within the interior void; and a control module operably coupled to the adjustment element and configured to translate the compressible component between a relaxed state and a constricted state by controlling a volume of fluid within the interior void in response to a geographical location of the control module and a type of clothing worn in conjunction with the wearable article.

2. The adjustment system of claim 1, wherein the control module is operable to translate the compressible component between the relaxed state and the constricted state in response to motion, a humidity, and/or a temperature of the wearable article.

3. The adjustment system of claim 1, wherein the control module is operable to translate the compressible component between the relaxed state and the constricted state in response to the geographical location of the control module in combination with a type of activity.

4. The adjustment system of claim 1, wherein the geographical location is input by a wearer.

5. The adjustment system of claim 1, wherein the geographical location is determined using a Global Positioning System (GPS).

6. The adjustment system of claim 1, further comprising at least one of a humidity sensor, a temperature sensor, or an accelerometer in communication with the control module, the at least one of the humidity sensor, the temperature sensor, and the accelerometer operable to provide the control module with data for use by the control module in determining a degree to which the compressible component is moved from the relaxed state to the constricted state.

7. The adjustment system of claim 1, further comprising an RFID reader associated with the control module, the control module operable to translate the compressible component between the relaxed state and the constricted state based on data received by the RFID reader.

8. The adjustment system of claim 7, further comprising an RFID tag associated with an article of apparel or an article of footwear, the RFID tag in communication with the RFID reader and operable to provide the data to the RFID reader.

9. The adjustment system of claim 1, further comprising a controller in communication with the control module and operable to display a status of the compressible component.

10. An adjustment system for a wearable article, the adjustment system comprising:

an adjustment element operable to form at least a portion of the wearable article and including (i) a bladder including an interior void and (ii) a compressible component disposed within the interior void; and a control module operably coupled to the adjustment element and configured to translate the compressible component between a relaxed state and a constricted state by controlling a volume of fluid within the interior void in response to detecting a type of secondary wearable article used in conjunction with the wearable article.

11. The adjustment system of claim 10, wherein the control module is operable to translate the compressible component between the relaxed state and the constricted state in response to a condition-responsive parameter.

12. The adjustment system of claim 11, wherein the condition-responsive parameter comprises motion, humidity, and/or temperature.

13. The adjustment system of claim 10, wherein the control module is operable to translate the compressible component between the relaxed state and the constricted state in response to a geographical location input by a wearer.

14. The adjustment system of claim 10, wherein the control module is operable to translate the compressible component between the relaxed state and the constricted state in response to a geographical location determined using a Global Positioning System (GPS).

15. The adjustment system of claim 10, further comprising at least one of a humidity sensor, a temperature sensor, or an accelerometer in communication with the control module, the at least one of the humidity sensor, the temperature sensor, and the accelerometer operable to provide the control module with a condition-responsive parameter.

16. The adjustment system of claim 15, wherein the control module is operable to translate the compressible component between the relaxed state and the constricted state in response to the condition-responsive parameter.

17. The adjustment system of claim 10, further comprising an RFID reader associated with the control module, the control module operable to translate the compressible component between the relaxed state and the constricted state based on data received by the RFID reader.

18. The adjustment system of claim 17, further comprising an RFID tag associated with the secondary wearable article, the RFID tag in communication with the RFID reader and operable to provide the data to the RFID reader.

19. The adjustment system of claim 10, further comprising a controller in communication with the control module and operable to display a status of the compressible component.

20. The adjustment system of claim 10, wherein the compressible component includes a lattice structure defining a plurality of reliefs each formed through a thickness of the compressible component.

* * * * *